US007731891B2

(12) United States Patent
Cooper

(10) Patent No.: US 7,731,891 B2
(45) Date of Patent: Jun. 8, 2010

(54) COUPLINGS FOR MOLTEN METAL DEVICES

(76) Inventor: Paul V. Cooper, 11247 Lake Forest Dr., Chesterland, OH (US) 44026

( * ) Notice: Subject to any disclaimer, the term of this patent is extended or adjusted under 35 U.S.C. 154(b) by 555 days.

(21) Appl. No.: 10/620,318

(22) Filed: Jul. 14, 2003

(65) Prior Publication Data

US 2004/0076533 A1 Apr. 22, 2004

Related U.S. Application Data

(60) Provisional application No. 60/395,471, filed on Jul. 12, 2002.

(51) Int. Cl.
*F04B 17/00* (2006.01)

(52) U.S. Cl. ..... 266/239

(58) Field of Classification Search ..... 403/342; 266/239

See application file for complete search history.

(56) References Cited

U.S. PATENT DOCUMENTS

| | | | | |
|---|---|---|---|---|
| 209,219 | A | 10/1878 | Bookwalter | |
| 251,104 | A | 12/1881 | Finch | |
| 364,804 | A | 6/1887 | Cole | |
| 506,572 | A | 10/1893 | Wagener | |
| 585,188 | A | 6/1897 | Davis | |
| 898,499 | A | 9/1908 | O'Donnell | |
| 1,100,475 | A | 6/1914 | Franckaerts | |
| 1,331,997 | A | 2/1920 | Neal | |
| 1,377,101 | A * | 5/1921 | Sparling | 403/313 |
| 1,454,967 | A | 5/1923 | Gill | |
| 1,518,501 | A | 12/1924 | Gill | |
| 1,522,765 | A | 1/1925 | Wilke | |
| 1,526,851 | A | 2/1925 | Hall | |
| 1,669,668 | A | 5/1928 | Marshall | |
| 1,673,594 | A | 6/1928 | Schmidt | |
| 1,717,969 | A | 6/1929 | Goodner | |
| 1,896,201 | A | 2/1933 | Sterner-Rainer | |
| 2,038,221 | A | 4/1936 | Kagi | |
| 2,280,979 | A | 4/1942 | Rocke | |
| 2,290,961 | A | 7/1942 | Heuer | |

(Continued)

FOREIGN PATENT DOCUMENTS

| | | |
|---|---|---|
| CA | 683469 | 3/1964 |

(Continued)

*Primary Examiner*—Scott Kastler
(74) *Attorney, Agent, or Firm*—David E. Rogers; Alex Starkovich; Squire, Sanders & Demspey L.L.P.

(57) ABSTRACT

Disclosed are couplings for use in devices positioned in a molten metal bath. One is a rigid coupling that may include a counterweight, the coupling to reduce nonconcentric movements during rotation of a shaft, particularly a rotor shaft. Another coupling uses magnetic force, rather than a direct physical connection, to form a driving connection between a drive shaft (such as a motor drive shaft) and a driven shaft (such as a rotor shaft). In the event the rotor is jammed, the increased torque creates an overload that disconnects the drive shaft from the driven shaft in order to help prevent damage to the rotor, driven shaft, drive shaft and other components. Also disclosed is a coupling to transfer gas into a shaft, the coupling having a non-threaded internal surface to help prevent gas leakage and thus assist in preventing any resulting damage to the coupling and shaft.

12 Claims, 22 Drawing Sheets

U.S. PATENT DOCUMENTS 2,423,655 A * 7/1947 Mars et al. ..... 285/341
2,488,447 A 11/1949 Tangen et al.
2,515,478 A 7/1950 Tooley et al.
2,528,210 A 10/1950 Stewart
2,566,892 A 9/1951 Jacobs
2,677,609 A 5/1954 Moore et al.
2,698,583 A 1/1955 House et al.
2,787,873 A 4/1957 Hadley
2,808,782 A 10/1957 Thompson et al.
2,821,472 A 1/1958 Peterson et al.
2,832,292 A 4/1958 Edwards
2,865,618 A 12/1958 Abell
2,901,677 A 8/1959 Chessman et al.
2,948,524 A 8/1960 Sweeney et al.
2,978,885 A 4/1961 Davison
2,984,524 A 5/1961 Franzen
2,987,885 A 6/1961 Hodge
3,010,402 A 11/1961 King
3,048,384 A 8/1962 Sweeney et al.
3,070,393 A 12/1962 Silverberg et al.
3,092,030 A 6/1963 Wunder
3,227,547 A 1/1966 Szekely
3,244,109 A 4/1966 Barske
3,251,676 A 5/1966 Johnson
3,255,702 A 6/1966 Gehrm
3,258,283 A * 6/1966 Winberg et al. ..... 403/379.4
3,272,619 A 9/1966 Sweeney et al.
3,289,473 A 12/1966 Louda
3,291,473 A 12/1966 Sweeney et al.
3,400,923 A * 9/1968 Howie et al. ..... 266/235
3,417,929 A 12/1968 Secrest et al.
3,459,133 A 8/1969 Scheffler
3,459,346 A 8/1969 Tinnes
3,487,805 A 1/1970 Satterthwaite
3,512,762 A 5/1970 Umbricht
3,512,788 A 5/1970 Kilbane
3,575,525 A 4/1971 Fox et al.
3,618,917 A 11/1971 Fredrikson
3,650,730 A 3/1972 Derham et al.
3,689,048 A 9/1972 Foulard et al.
3,715,112 A 2/1973 Carbonnel
3,743,263 A 7/1973 Szekely
3,743,500 A 7/1973 Foulard et al.
3,753,690 A 8/1973 Emley et al.
3,759,635 A 9/1973 Carter et al.
3,767,382 A 10/1973 Bruno et al.
3,776,660 A 12/1973 Anderson et al.
3,785,632 A 1/1974 Kraemer et al.
3,814,400 A 6/1974 Seki
3,824,042 A 7/1974 Barnes et al.
3,836,280 A 9/1974 Koch
3,839,019 A 10/1974 Bruno et al.
3,871,872 A 3/1975 Downing et al.
3,873,305 A 3/1975 Claxton et al.
3,886,992 A 6/1975 Maas et al.
3,915,694 A 10/1975 Ando
3,954,134 A 5/1976 Maas et al.
3,961,778 A 6/1976 Carbonnel et al.
3,966,456 A 6/1976 Ellenbaum et al.
3,972,709 A 8/1976 Chia et al.
3,984,234 A 10/1976 Claxton et al.
3,985,000 A 10/1976 Hartz
3,997,336 A 12/1976 van Linden et al.
4,003,560 A 1/1977 Carbonnel
4,018,598 A 4/1977 Markus
4,052,199 A 10/1977 Mangalick
4,055,390 A 10/1977 Young
4,068,965 A 1/1978 Lichti
4,091,970 A 5/1978 Kimiyama et al.
4,119,141 A 10/1978 Thut et al.
4,126,360 A 11/1978 Miller et al.
4,128,415 A 12/1978 van Linden et al.
4,144,562 A 3/1979 Cooper
4,169,584 A 10/1979 Mangalick
4,192,011 A 3/1980 Cooper et al.
4,213,091 A 7/1980 Cooper
4,213,176 A 7/1980 Cooper
4,219,882 A 8/1980 Cooper et al.
4,244,423 A 1/1981 Thut et al.
4,286,985 A 9/1981 van Linden et al.
4,322,245 A 3/1982 Claxton
4,347,041 A 8/1982 Cooper
4,351,514 A 9/1982 Koch
4,360,314 A 11/1982 Pennell
4,370,096 A 1/1983 Church
4,372,541 A 2/1983 Bocourt et al.
4,375,937 A 3/1983 Cooper
4,392,888 A 7/1983 Eckert et al.
4,410,299 A 10/1983 Shimoyama
4,456,424 A 6/1984 Araoka
4,456,974 A 6/1984 Cooper
4,470,846 A 9/1984 Dube
4,489,475 A 12/1984 Struttmann
4,504,392 A 3/1985 Groteke
4,537,624 A 8/1985 Tenhover et al.
4,537,625 A 8/1985 Tenhover et al.
4,556,419 A 12/1985 Otsuka et al.
4,557,766 A 12/1985 Tenhover et al.
4,586,845 A 5/1986 Morris
4,593,597 A 6/1986 Albrecht et al.
4,598,899 A 7/1986 Cooper
4,600,222 A 7/1986 Appling
4,609,442 A 9/1986 Tenhover et al.
4,611,790 A 9/1986 Otsuka et al.
4,634,105 A 1/1987 Withers et al.
4,640,666 A 2/1987 Sodergard
4,651,806 A 3/1987 Allen et al.
4,696,703 A 9/1987 Henderson et al.
4,701,226 A 10/1987 Henderson et al.
4,714,371 A 12/1987 Cuse
4,717,540 A 1/1988 McRae et al.
4,743,428 A 5/1988 McRae et al.
4,747,583 A 5/1988 Gordon et al.
4,767,230 A * 8/1988 Leas, Jr. ..... 403/16
4,770,701 A 9/1988 Henderson et al.
4,786,230 A 11/1988 Thut
4,802,656 A 2/1989 Hudault et al.
4,804,168 A 2/1989 Otsuka et al.
4,810,314 A 3/1989 Henderson et al.
4,834,573 A 5/1989 Asano et al.
4,842,227 A 6/1989 Harrington et al.
4,844,425 A 7/1989 Piras et al.
4,851,296 A 7/1989 Tenhover et al.
4,859,413 A 8/1989 Harris et al.
4,867,638 A 9/1989 Handtmann et al.
4,884,786 A 12/1989 Gillespie
4,898,367 A 2/1990 Cooper
4,923,770 A 5/1990 Grasselli et al.
4,930,986 A 6/1990 Cooper
4,931,091 A 6/1990 Waite et al.
4,940,214 A 7/1990 Gillespie
4,940,384 A 7/1990 Amra et al.
4,954,167 A 9/1990 Cooper
4,973,433 A 11/1990 Gilbert et al.
4,989,736 A 2/1991 Andersson et al.
5,006,232 A 4/1991 Lidgitt et al.
5,028,211 A 7/1991 Mordue et al.
5,049,841 A 9/1991 Cooper et al.
5,078,572 A 1/1992 Amra et al.
5,088,893 A 2/1992 Gilbert et al.
5,092,821 A 3/1992 Gilbert et al.
5,098,134 A 3/1992 Monckton
5,099,554 A 3/1992 Cooper
5,131,632 A 7/1992 Olson 5,143,357 A 9/1992 Gilbert et al.
5,145,322 A 9/1992 Senior, Jr. et al.
5,152,631 A 10/1992 Bauer
5,154,652 A * 10/1992 Ecklesdafer ..... 440/83
5,158,440 A 10/1992 Cooper et al.
5,162,858 A 11/1992 Shoji et al.
5,165,858 A 11/1992 Gilbert et al.
5,172,458 A 12/1992 Cooper
5,177,304 A 1/1993 Nagel
5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoglund et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A 7/1994 Cooper
5,354,940 A 10/1994 Nagel
5,358,549 A 10/1994 Nagel et al.
5,358,697 A 10/1994 Nagel
5,364,078 A 11/1994 Pelton
5,369,063 A 11/1994 Gee et al.
5,383,651 A 1/1995 Blasen et al.
5,388,633 A 2/1995 Mercer, II et al.
5,395,405 A 3/1995 Nagel et al.
5,399,074 A 3/1995 Nose et al.
5,407,294 A 4/1995 Giannini
5,425,410 A 6/1995 Reynolds
5,431,551 A 7/1995 Aquino et al.
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.
5,489,734 A 2/1996 Nagel et al.
5,491,279 A 2/1996 Robert et al.
5,495,746 A 3/1996 Sigworth
5,505,143 A 4/1996 Nagel
5,509,791 A 4/1996 Turner
5,537,940 A 7/1996 Nagel et al.
5,543,558 A 8/1996 Nagel et al.
5,555,822 A 9/1996 Loewen et al.
5,558,501 A 9/1996 Wang et al.
5,558,505 A 9/1996 Mordue et al.
5,571,486 A 11/1996 Robert et al.
5,585,532 A 12/1996 Nagel
5,586,863 A 12/1996 Gilbert et al.
5,597,289 A 1/1997 Thut
5,613,245 A 3/1997 Robert
5,622,481 A 4/1997 Thut
5,629,464 A 5/1997 Bach et al.
5,634,770 A 6/1997 Gilbert et al.
5,640,706 A 6/1997 Nagel et al.
5,640,707 A 6/1997 Nagel et al.
5,640,709 A 6/1997 Nagel et al.
5,655,849 A 8/1997 McEwan et al.
5,662,725 A 9/1997 Cooper
5,676,520 A 10/1997 Thut
5,678,244 A 10/1997 Shaw et al.
5,678,807 A * 10/1997 Cooper ..... 266/216
5,679,132 A 10/1997 Rauenzahn et al.
5,685,701 A 11/1997 Chandler et al.
5,690,888 A 11/1997 Robert
5,695,732 A 12/1997 Sparks et al.
5,716,195 A 2/1998 Thut
5,717,149 A 2/1998 Nagel et al.
5,718,416 A 2/1998 Flisakowski et al.
5,735,668 A 4/1998 Klien
5,735,935 A 4/1998 Areaux
5,741,422 A 4/1998 Eichenmiller et al.
5,744,117 A 4/1998 Wilkinson et al.
5,745,861 A 4/1998 Bell et al.
5,755,847 A 5/1998 Quayle
5,772,324 A 6/1998 Falk
5,776,420 A 7/1998 Nagel
5,785,494 A 7/1998 Vild et al.
5,805,067 A 9/1998 Bradley et al.
5,810,311 A 9/1998 Davison et al.
5,842,832 A 12/1998 Thut
5,858,059 A 1/1999 Abramovich et al.
5,864,316 A 1/1999 Bradley et al.
5,866,095 A 2/1999 McGeever et al.
5,875,385 A 2/1999 Stephenson et al.
5,935,528 A 8/1999 Stephenson et al.
5,944,496 A * 8/1999 Cooper ..... 417/423.3
5,947,705 A 9/1999 Mordue et al.
5,949,369 A 9/1999 Bradley et al.
5,951,243 A 9/1999 Cooper
5,993,726 A 11/1999 Huang
5,993,728 A 11/1999 Vild
5,995,041 A 11/1999 Bradley et al.
6,019,576 A 2/2000 Thut
6,024,286 A 2/2000 Bradley et al.
6,027,685 A 2/2000 Cooper
6,036,745 A 3/2000 Gilbert et al.
6,074,455 A 6/2000 van Linden et al.
6,093,000 A * 7/2000 Cooper ..... 417/423.6
6,096,109 A 8/2000 Nagel et al.
6,113,154 A 9/2000 Thut
6,123,523 A 9/2000 Cooper
6,152,691 A 11/2000 Thut
6,187,096 B1 2/2001 Thut
6,217,823 B1 4/2001 Vild et al.
6,231,639 B1 5/2001 Eichenmiller et al.
6,243,366 B1 6/2001 Bradley et al.
6,250,881 B1 6/2001 Mordue et al.
6,254,340 B1 7/2001 Vild et al.
6,270,717 B1 8/2001 Tremblay et al.
6,280,157 B1 8/2001 Cooper
6,293,759 B1 9/2001 Thut
6,303,074 B1 * 10/2001 Cooper ..... 266/235
6,345,964 B1 2/2002 Cooper
6,358,467 B1 * 3/2002 Mordue ..... 266/235
6,398,525 B1 * 6/2002 Cooper ..... 417/423.6
6,439,860 B1 * 8/2002 Greer ..... 417/360
6,451,247 B1 * 9/2002 Mordue et al. ..... 266/239
6,457,950 B1 10/2002 Cooper et al.
6,464,458 B2 10/2002 Vild et al.
6,495,948 B1 12/2002 Garrett, III
6,497,559 B1 12/2002 Grant
6,524,066 B2 2/2003 Thut
6,533,535 B2 3/2003 Thut
6,551,060 B2 4/2003 Mordue et al.
6,648,026 B2 11/2003 Look et al.
6,679,936 B2 1/2004 Quackenbush
6,689,310 B1 2/2004 Cooper
6,695,510 B1 2/2004 Look et al.
6,709,234 B2 3/2004 Gilbert et al.
6,716,147 B1 4/2004 Hinkle et al.
6,723,276 B1 4/2004 Cooper
6,805,834 B2 10/2004 Thut
6,843,640 B2 1/2005 Mordue et al.
6,848,497 B2 2/2005 Sale et al.
6,869,564 B2 3/2005 Gilbert et al.
6,881,030 B2 4/2005 Thut
6,887,424 B2 5/2005 Ohno et al.

| | | | |
|---|---|---|---|
| 6,887,425 | B2 | 5/2005 | Mordue et al. |
| 6,896,825 | B1 | 5/2005 | Uchida et al. |
| 2001/0000465 | A1 | 4/2001 | Thut |
| 2001/0012758 | A1 | 8/2001 | Bradley et al. |
| 2002/0041788 | A1 | 4/2002 | Look et al. |
| 2002/0102159 | A1 | 8/2002 | Thut |
| 2002/0146313 | A1 | 10/2002 | Thut |
| 2002/0187947 | A1 | 12/2002 | Jarai et al. |
| 2003/0059302 | A1 | 3/2003 | Mordue et al. |
| 2003/0075844 | A1 | 4/2003 | Mordue et al. |
| 2003/0151176 | A1 | 8/2003 | Ohno et al. |
| 2003/0185679 | A1 | 10/2003 | Mordue et al. |
| 2004/0007284 | A1 | 1/2004 | Look et al. |
| 2004/0022632 | A1 | 2/2004 | Thut |
| 2004/0056395 | A1 | 3/2004 | Thut |
| 2004/0076533 | A1 | 4/2004 | Cooper |
| 2004/0084172 | A1 | 5/2004 | Vincent et al. |
| 2004/0115079 | A1 | 6/2004 | Cooper |
| 2004/0123970 | A1 | 7/2004 | Neff |
| 2004/0199435 | A1 | 10/2004 | Abrams et al. |
| 2004/0215204 | A1 | 10/2004 | Davison et al. |
| 2004/0262825 | A1 | 12/2004 | Cooper |
| 2005/0013713 | A1 | 1/2005 | Cooper |
| 2005/0013714 | A1 | 1/2005 | Cooper |
| 2005/0013715 | A1 | 1/2005 | Cooper |
| 2005/0053499 | A1 | 3/2005 | Cooper |
| 2005/0077730 | A1 | 4/2005 | Thut |
| 2005/0081607 | A1 | 4/2005 | Patel et al. |
| 2005/0116398 | A1 | 6/2005 | Tremblay |

FOREIGN PATENT DOCUMENTS

| | | | | |
|---|---|---|---|---|
| CH | 392268 | | | 9/1965 |
| DE | 1800446 | | | 12/1969 |
| EP | 0665378 | A1 | | 2/1995 |
| GB | 942648 | | | 11/1963 |
| GB | 1185314 | | | 3/1970 |
| GB | 2217784 | A | | 3/1989 |
| JP | 58-48796 | | | 3/1983 |
| JP | 63-104773 | | | 5/1998 |
| NO | 90756 | | | 1/1958 |
| SU | 416401 | | | 6/1974 |
| SU | 773312 | | | 10/1980 |
| WO | WO 98/08990 | | * | 3/1998 |
| WO | WO 98/25031 | | * | 6/1998 |

* cited by examiner

COUPLINGS FOR MOLTEN METAL DEVICES

CROSS REFERENCE TO RELATED APPLICATION

This application claims the benefit of provisional application No. 60/395,471, entitled "Couplings and Protective Coatings for Molten Metal Devices," filed on Jul. 12, 2002.

FIELD OF THE INVENTION

The invention relates to novel couplings that may be used in various devices, such as pumps, degassers and scrap melters used in molten metal baths. One aspect of the invention is a rigid coupling including a counterweight to generally maintain concentric rotation of the shaft. Another aspect of the invention is a rotor shaft to motor shaft coupling that decreases the possibility of breakage, maintenance and downtime in case the rotor is jammed. Another aspect is a shaft coupling for transferring gas that, among other things, decreases the possibility of gas leakage.

BACKGROUND OF THE INVENTION

As used herein, the term "molten metal" means any metal or combination of metals in liquid form, such as aluminum, copper, iron, zinc and alloys thereof. The term "gas" means any gas or combination of gases, including argon, nitrogen, chlorine, fluorine, freon, and helium, that are released into with molten metal.

Known molten-metal pumps include a pump base (also called a housing or casing), one or more inlets (an inlet being an opening in the housing to allow molten metal to enter a pump chamber), a pump chamber, which is an open area formed within the housing, and a discharge, which is a channel or conduit of any structure or type communicating with the pump chamber (in an axial pump the chamber and discharge may be the same structure or different areas of the same structure) leading from the pump chamber to an outlet, which is an opening formed in the exterior of the housing through which molten metal exits the casing. A rotor, also called an impeller, is mounted in the pump chamber and is connected to a drive system. The drive system is typically a rotor shaft connected to one end of a drive shaft, the other end of the drive shaft being connected to a motor. Often, the rotor shaft is comprised of graphite, the motor shaft is comprised of steel and the two are connected by a coupling. As the motor turns the drive shaft the drive shaft turns the rotor and the rotor pushes molten metal out of the pump chamber, through the discharge, out of the outlet and into the molten metal bath. Most molten metal pumps are gravity fed, wherein gravity forces molten metal through the inlet and into the pump chamber as the rotor pushes molten metal out of the pump chamber.

Molten metal pump casings and rotors usually employ a bearing system comprising ceramic rings wherein there are one or more rings on the rotor that align with rings in the pump chamber (such as rings at the inlet and outlet) when the rotor is placed in the pump chamber. The purpose of the bearing system is to reduce damage to the soft, graphite components, particularly the rotor and pump base, during pump operation. A known bearing system is described in U.S. Pat. No. 5,203,681 to Cooper, the disclosure of which is incorporated herein by reference. As discussed in U.S. Pat. Nos. 5,591,243 and 6,093,000, each to Cooper, the disclosures of which are incorporated herein by reference, bearing rings can cause various operational and shipping problems. To help alleviate this problem, U.S. Pat. No. 6,093,000 discloses a rigid coupling to enable the use of a monolithic rotor without any separate bearing member. The rigid coupling assists in maintaining the rotor centered within the pumping chamber and rotating concentrically (i.e., without wobble). If the rotor wobbles too much while it rotates, it may bump against the inner surface of the pump chamber or other components, such as ceramic bearing rings, causing damage to itself and/or other parts, hinder smooth rotation of the pump and cause downtime and maintenance costs. Positioning and maintaining the rotor in the center of the pumping chamber and reducing any nonconcentric movements that would cause the rotor to contact other parts of the pump would help to prevent damage to the pumping device and reduce downtime and the need for replacement components. Moreover, if the rotor is maintained in the center of the pump chamber the bearing rings or bearing members could potentially be eliminated.

A number of submersible pumps used to pump molten metal (referred to herein as molten metal pumps) are known in the art. For example, U.S. Pat. No. 2,948,524 to Sweeney et al., U.S. Pat. No. 4,169,584 to Mangalick, U.S. Pat. No. 5,203,681 to Cooper, U.S. Pat. No. 6,093,000 to Cooper and U.S. Pat. No. 6,123,523 to Cooper all disclose molten metal pumps. The term submersible means that when the pump is in use its base is submerged in a bath of molten metal.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Most often, circulation pumps are used in a reverbatory furnace having an external well. The well is usually an extension of the charging well where scrap metal is charged (i.e., added).

Transfer pumps are generally used to transfer molten metal from the external well of a reverbatory furnace to a different location such as a ladle or another furnace.

Gas-release pumps, such as gas-injection pumps, circulate molten metal while introducing a gas into the molten metal. In the purification of molten metals, particularly aluminum, it is frequently desired to remove dissolved gases such as hydrogen, or dissolved metals, such as magnesium. As is known by those skilled in the art, the removing of dissolved gas is known as "degassing" while the removal of magnesium is known as "demagging." Gas-release pumps may be used for either of these purposes or for any other application for which it is desirable to introduce gas into molten metal.

Gas-release pumps generally include a gas-transfer conduit having a first end that is connected to a gas source and a second submerged in the molten metal bath. Gas is introduced into the first end and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where it enters the pump chamber.

Generally, a degasser (also called a rotary degasser) includes (1) a rotor shaft having a first end, a second end and a passage for transferring gas, (2) an impeller, and (3) a drive source for rotating the rotor shaft and the impeller. The first end of the rotor shaft is connected to the drive source and to a gas source and the second end is connected to the connector of the impeller. Examples of rotary degassers are disclosed in U.S. Pat. No. 4,898,367 entitled "Dispersing Gas Into Molten Metal," U.S. Pat. No. 5,678,807 entitled "Rotary Degassers," and U.S. application Ser. No. 09/569,461 to Cooper entitled "Molten Metal Degassing Device," filed May 12, 2000, the respective disclosures of which are incorporated herein by reference.

In known rotary degassers, gas is transferred from a gas source through the rotor shaft and into the molten metal. Usually, the gas is transferred to a rotary union connected at one end to a passage in the motor shaft and connected at the other end to gas source. Gas is transferred through the motor shaft passage into a coupling and then transferred via the coupling into a passage in the rotor shaft. The gas is released from the end of the rotor shaft submersed in the molten metal bath. Known coupling-to-rotor shaft connections are usually threaded, and gas can seep into the threaded connections causing the graphite threads of the rotor shaft to wear. This leads to maintenance, downtime and component replacement.

Generally a scrap melter includes an impeller affixed to an end of a drive shaft, and a drive source attached to the other end of the drive shaft for rotating the shaft and the impeller. The movement of the impeller draws molten metal and scrap metal downward into the molten metal bath in order to melt the scrap. A circulation pump is preferably used in conjunction with the scrap melter to circulate the molten metal in order to maintain a relatively constant temperature within the molten metal. Scrap melters are disclosed in U.S. Pat. No. 4,598,899, to Cooper U.S. patent application Ser. No. 09/649,190 to Cooper, filed Aug. 28, 2000, and U.S. Pat. No. 4,930,986 to Cooper, the respective disclosures of which are incorporated herein by reference.

The materials forming the components used in a molten metal bath should remain relatively stable in the bath. Structural refractory materials, such as graphite or ceramics, that are resistant to disintegration by corrosive attack from the molten metal may be used. As used herein "ceramics", or "ceramic" refers to any oxidized metal (including silicon) or carbon-based material, excluding graphite, capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

In addition to the afore-mentioned problems of nonconcentric movement and gas leakage, jamming is sometimes a problem with molten metal pumps. Pieces of brick, dross or other solids can pass into the pump chamber while the rotor is turning and become lodged between the rotor and pump chamber. This can cause the rotor to jam and damage the rotor and/or rotor shaft and/or rotor shaft-to-motor shaft coupling.

SUMMARY OF THE INVENTION

The present invention helps to alleviate the afore-mentioned problems by providing a coupling to maintain a rotor centered within the pumping chamber during operation of a molten metal pump, i.e., to help prevent nonconcentric movements that may cause the rotor to bump or rub or bump against the pump chamber or bearing surfaces. The rigid coupling of the present invention may include a counterweight to balance the coupling, and allows the rotor shaft and rotor to rotate with relatively little wobble.

Another aspect of the invention is a coupling for transferring gas into a shaft (preferably a rotor shaft) and a shaft configured to be used with the coupling. The coupling preferably includes a coupling member having a bore with an opening, the bore including an end proximal to the opening and an end distal to the opening. The distal end is preferably smooth and tapered with no threads. The coupling is preferably threaded at the proximal end, most preferably with coarse threads. The end of the shaft configured to be received in the bore has a mating smooth, tapered portion and mating coarse threads. When the end of the shaft is received in the bore, the tapered portion of the shaft is received in and aligns with the tapered, distal end of the bore, which assists in centering the shaft. Further, the mating of the smooth, tapered surfaces helps to prevent gas leaks thereby leading to longer component life.

The invention also relates to a motor-shaft-to-rotor-shaft coupling that does not include a physical connection between the rotor shaft and motor shaft. Therefore, in the event the rotor becomes jammed, the resulting torque overloads the coupling, and the drive from the motor and motor shaft are disconnected from the rotor shaft and rotor, thus helping to prevent any component damage.

DETAILED DESCRIPTION OF A PREFERRED EMBODIMENT

Figure 1:
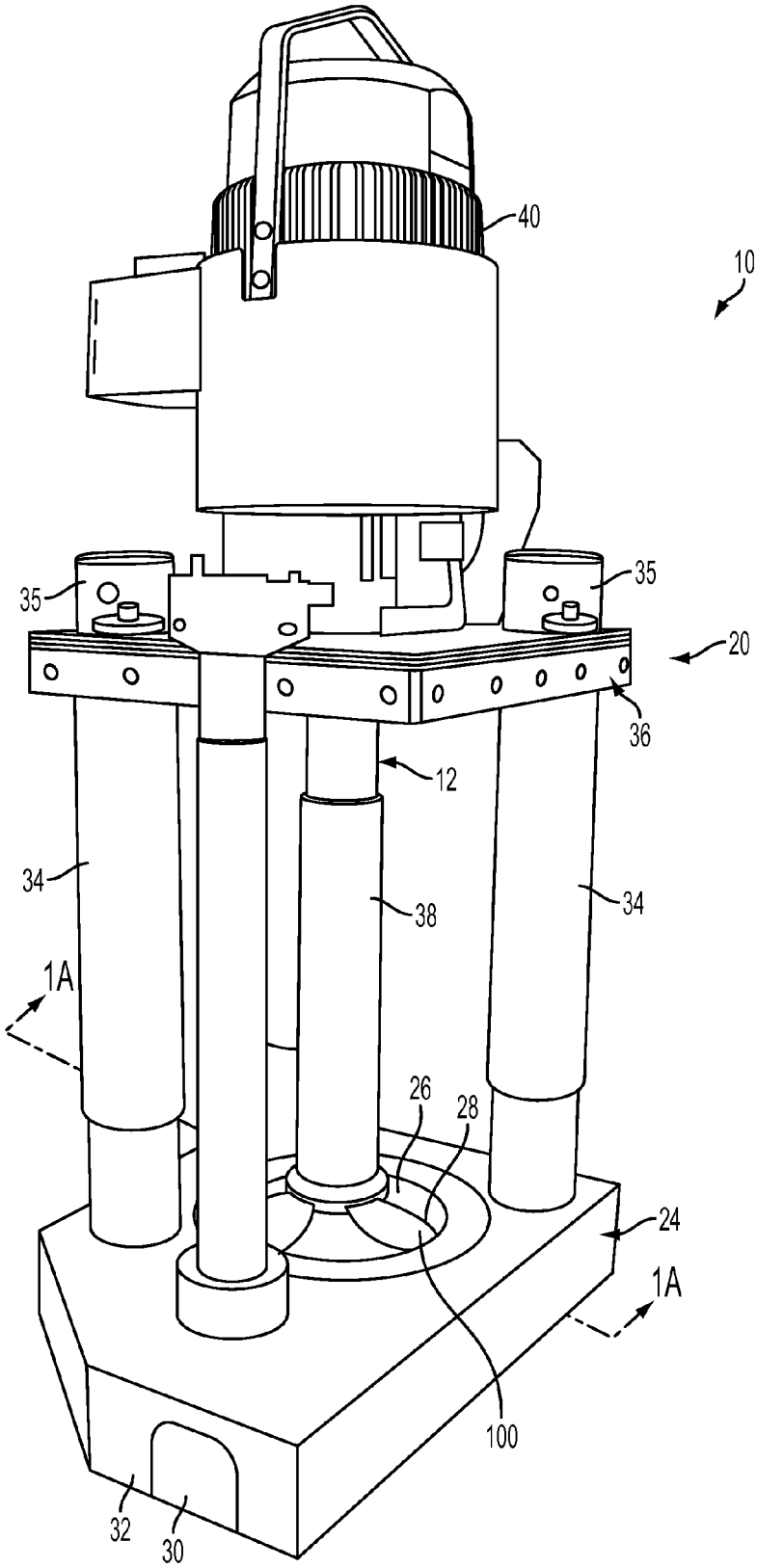
FIG. 1 is a perspective view of a pump for pumping molten metal, which may include a coupling (not shown) according to the invention.

Referring now to the drawing where the purpose is to illustrate and describe different embodiments of the invention, and not to limit same, FIG. 1 shows a molten metal pump 10 in accordance with the present invention. System 10 includes a pump 20. For any device described herein, any of the components that contact the molten metal are preferably formed by a material that can withstand the molten metal environment. Preferred materials are oxidation-resistant graphite and ceramics, such as silicon carbide. Oxidation-resistant graphite is most preferred because of its relatively low cost and ease of manufacturing. Additionally, any of the components may be "protected components" as described in a co-pending U.S. Application entitled "Protective Coatings For Molten Metal Devices," filed on Jul. 14, 2003, the inventor of which is Paul V. Cooper. The disclosure of this co-pending application is incorporated herein by reference.

Pump 20 is specifically designed for operation in a molten metal furnace or in any environment in which molten metal is to be pumped or otherwise conveyed. Pump 20 can be any structure or device for pumping or otherwise conveying molten metal, such as the tangential-discharge pump disclosed in U.S. Pat. No. 5,203,681 to Cooper, or an axial pump having an axial, rather than tangential, discharge, or any type of molten metal pump having any type of discharge. Basically, preferred pump 20 has a pump base 24 submersible in a molten metal bath B. Pump base 24 includes a generally nonvolute pump chamber 26, such as a cylindrical pump chamber or what has been called a "cut" volute (although pump base 24 may have any shape pump chamber suitable of being used, such as a volute-shaped chamber). Chamber 26 has a top inlet 28, bottom inlet 29, tangential discharge 30 (although another type of discharge, such as an axial discharge may be used), and outlet 32. One or more support posts 34 connect base 24 to a superstructure 36 of pump 20 thus supporting superstructure 36. Post clamps 35 secure posts 34 to superstructure 36. A rotor drive shaft 38 is connected at one end to rotor 100 and at the other end to a coupling (not shown in this figure). A motor 40, which can be any structure, system or device suitable for driving pump 20, but is preferably an electric, hydraulic or pneumatic motor, is positioned on superstructure 36 and is connected to a drive shaft 12. Drive shaft 12 can be any structure suitable for rotating the impeller, and preferably comprises a motor shaft (not shown in this figure) that connects to rotor shaft 38 via the coupling. Pump 20 is usually positioned in a pump well, which is part of the open well of a reverbatory furnace.

Figure 2:
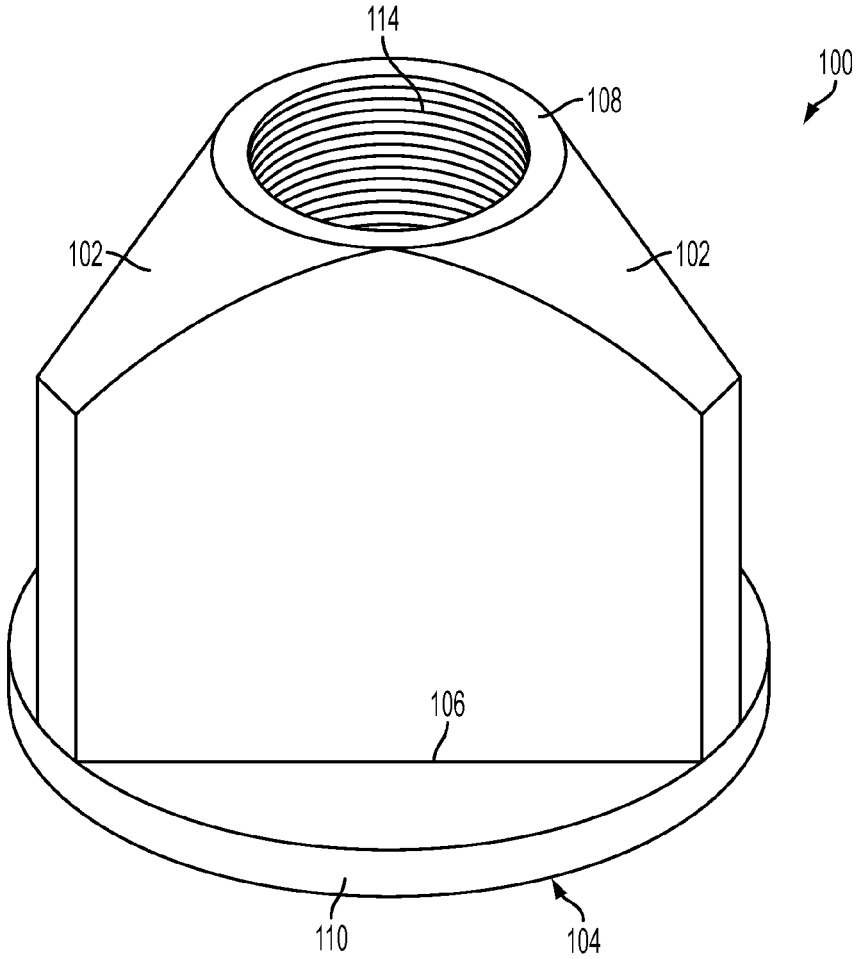
FIG. 2 is a perspective view of a rotor that may be used with the pump of FIG. 1.

A rotor, also called an impeller, 100 is positioned at least partially within pump chamber 26. Preferred rotor 100 is preferably imperforate, triangular (or trilobal), and includes a circular base 104 (as shown in FIG. 2) although any type or shape of impeller suitable for use in a molten metal pump may be used to practice the invention, such as a vaned impeller or a bladed impeller or a bird-cage impeller, these terms being known to those skilled in the art, and the impeller may or may not include a base. For example, U.S. Pat. No. 6,093,000 to Cooper discloses numerous impellers that may be used in a pump according to the invention. Such impellers may or may not include a bearing ring, bearing pin or bearing members.

A rotor 100, shown in FIG. 2, is sized to fit through both inlet openings 28 and 29. Rotor 100 preferably has three vanes 102. Rotor 100 also has a connecting portion 114 to connect to rotor drive shaft 38. A rotor base, also called a flow-blocking and bearing plate, 104 is mounted on either the bottom 106 or top 108 of rotor 100. Base 104 is sized to rotatably fit and be guided by the appropriate one of bearing ring members 60 or 60A mounted in casing 24, shown in FIG. 3. In the embodiment shown, base 104 has an outer perimeter 110. Preferably, one of inlet openings 28 and 29 is blocked, and most preferably bottom inlet 29 is blocked, by rotor base 104.

Figure 15:
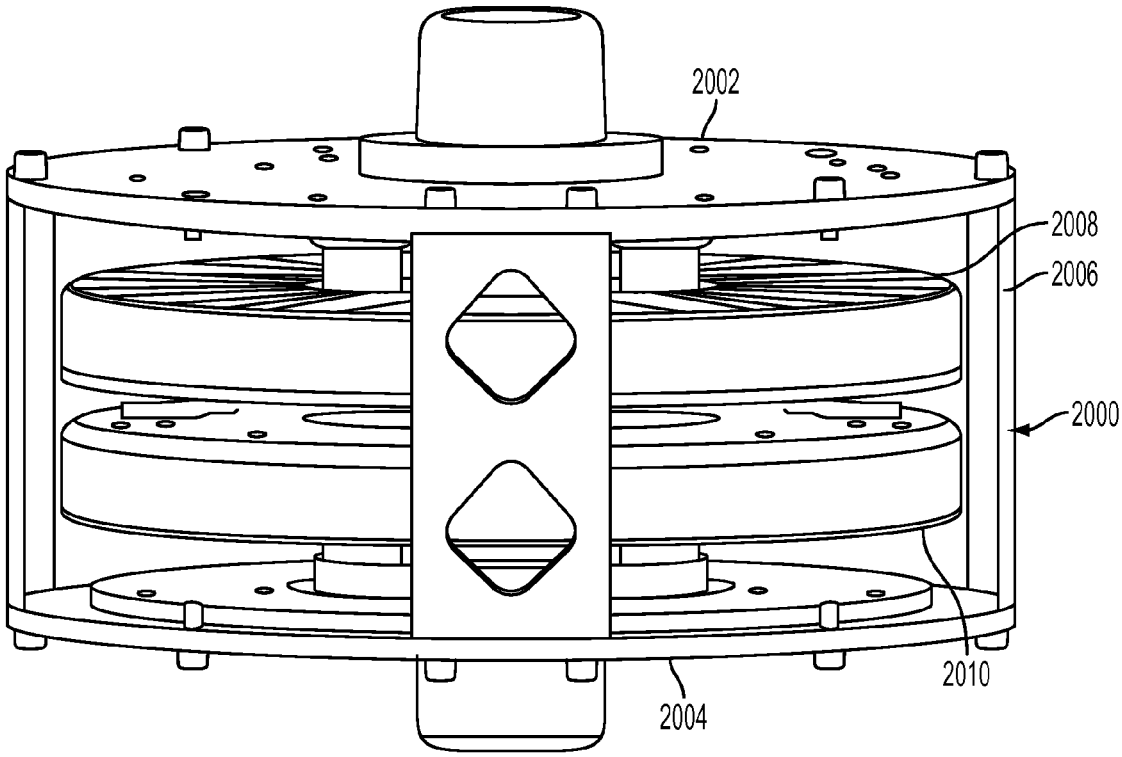
FIG. 15 is a side view of a preferred magnetic coupling that can be used in the practice of the invention.
Figure 16:
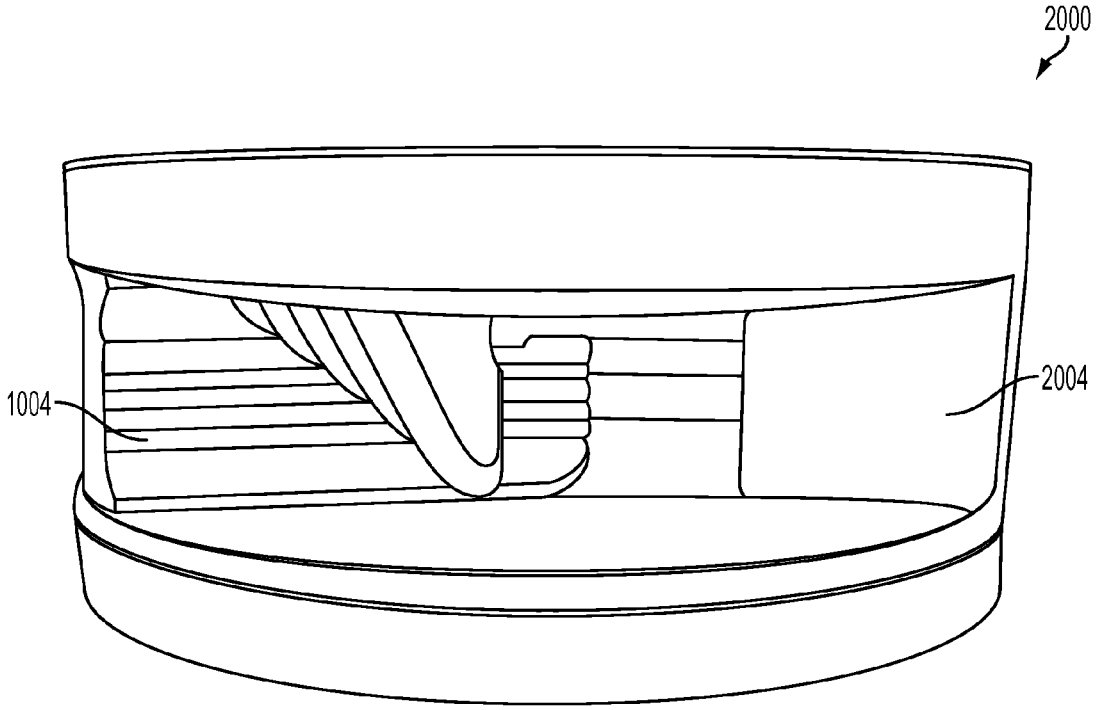
FIG. 16 is a side view of an alternate impeller that may be used with a pump according to the invention.
Figure 17:
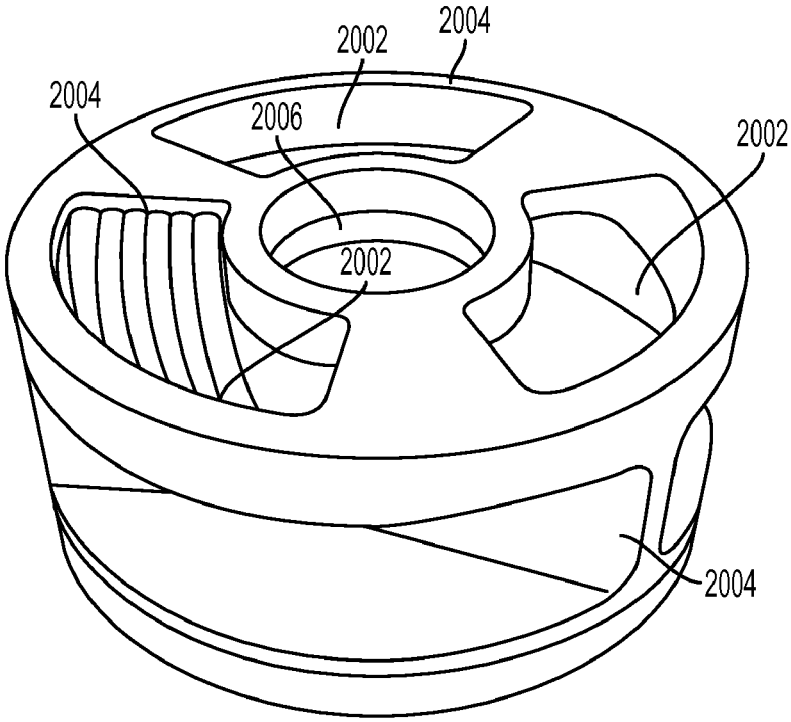
FIG. 17 is a front, perspective view of the impeller of FIG. 16.

Any suitable impeller may be used in the invention, and one preferred impeller is impeller 2000, shown in FIGS. 15-16. Impeller 2000 has multiple inlets 2002 preferably formed in its upper surface and multiple vanes 2004. Impeller 2000 includes a connection section 2006, which is preferably a threaded bore. Another alternate impeller 2100 is shown in FIG. 17. Impeller 2100 has a top surface 2102 including a connection section (not shown), which is preferably a threaded bore. Impeller 2100 also includes a base 2104 and vanes 2106.

Figure 3:
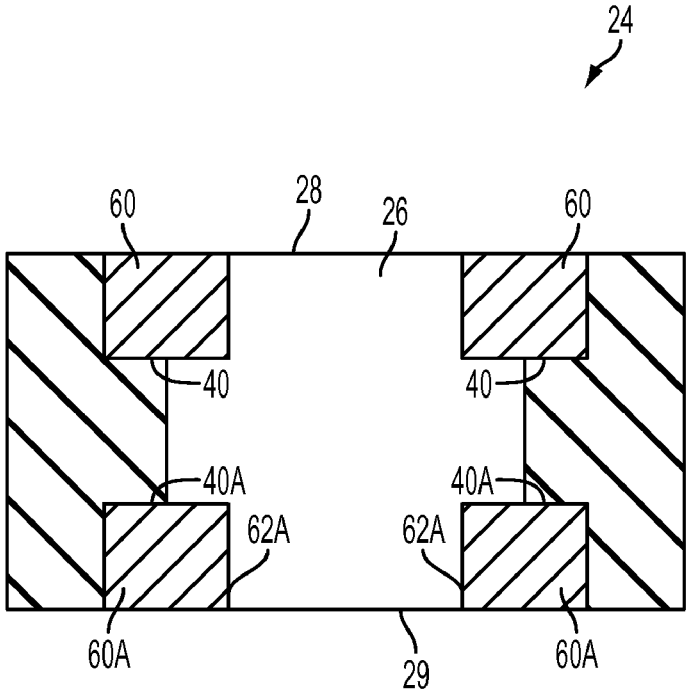
FIG. 3 is a cross-sectional view taken along line 1A-1A of FIG. 1 with the rotor removed.
Figure 3A:
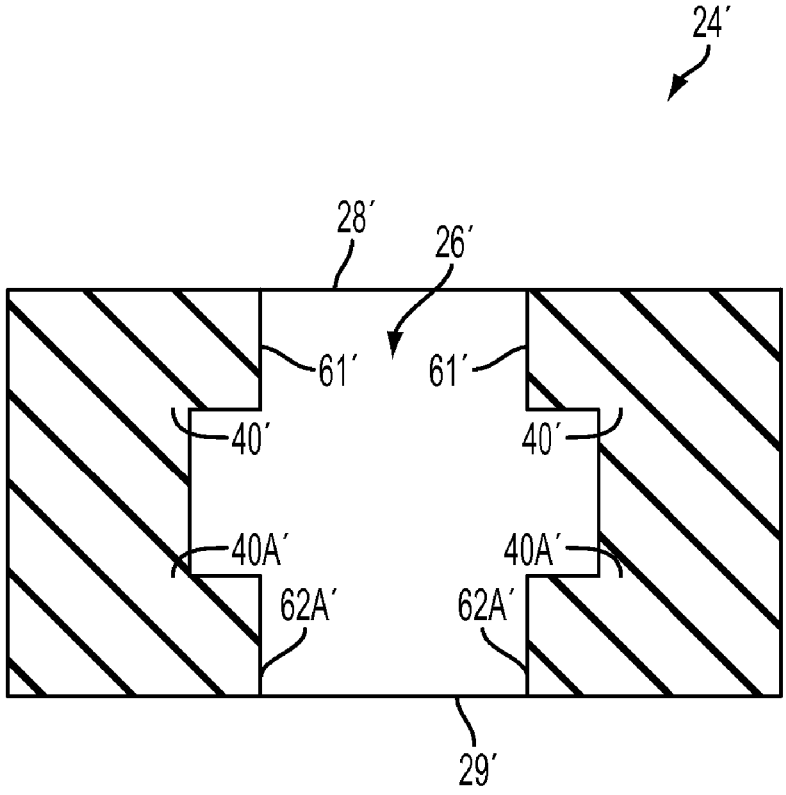
FIG. 3A is a cross-sectional view showing an alternate pump base without bearing rings.
Figure 4:
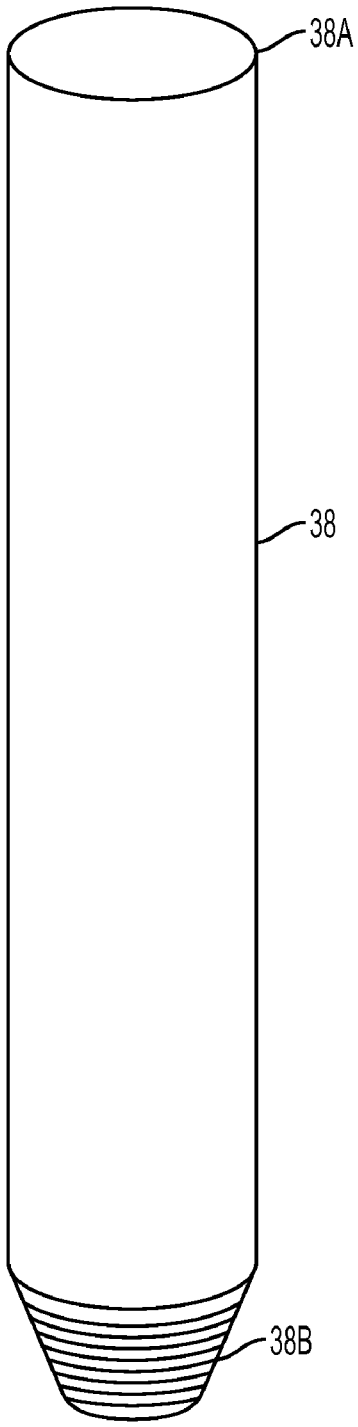
FIG. 4 is a perspective view of a rotor shaft that may be used with the pump of FIG. 1.
Figure 5:
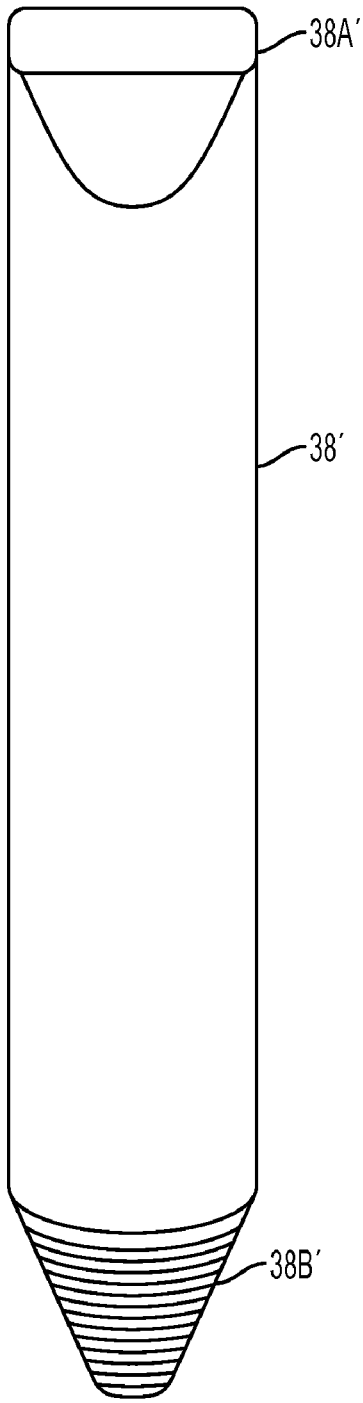
FIG. 5 is a perspective view of a rotor shaft having a top (or first) end with two opposing flat surfaces and two opposing curved surfaces.

As shown in FIG. 3, preferred pump base 24 can have a stepped surface 40 defined at the periphery of chamber 26 at inlet 28 and a stepped surface 40A defined at the periphery of inlet 29, although one stepped surface would suffice. Stepped surface 40 preferably receives a bearing ring member 60 and stepped surface 40A preferably received a bearing ring member 60A. Each bearing member 60, 60A is preferably comprised of silicon carbide. The outer diameter of members 60, 60A varies with the size of the pump, as will be understood by those skilled in the art. Bearing members 60, 60A each has a preferred thickness of 1" or greater. Preferably, bearing ring member 60, is provided at inlet 28 and bearing ring member 60A is provided at inlet 29, respectively, of casing 24. In the preferred embodiment, bottom bearing ring member 60A includes an inner perimeter, or first bearing surface, 62A, that aligns with a second bearing surface and guides rotor 100 as described herein. Alternatively, bearing ring members 60, 60A need not be used. For example, FIG. 3A shows a pump casing 24' that is preferably formed entirely of graphite. Such a pump casing 24' has no bearing ring, but instead has bearing surfaces 61' and 62A' integral with and formed of the same material as pump casing 24'. Pump casing 24' preferably, in all other respects, is the same as casing 24.

The rotor of the present invention may be monolithic, meaning for the purposes of this disclosure that it has no bearing member such as a separate ring or pin. A monolithic rotor may be used with any type or configuration of pump casing, including a casing with a bearing ring or a casing without a bearing ring. Rotor 100 as shown in FIG. 2 is monolithic and preferably formed of a single composition, such as oxidation-resistant graphite. As used herein, the term composition means any generally homogenous material and can be a homogenous blend of different materials. A monolithic rotor may be formed of multiple sections although it is preferred that it be a single, unitary component.

Bearing surface 110 is formed of the same material as rotor 100 and is preferably integral with rotor 100. Any of the previously described rotor configurations described herein (such as the rotors shown in U.S. Pat. No. 6,093,000) may be monolithic, having a second bearing surface comprised of the same composition as the rotor, and fitting into the pump chamber and against the first bearing surface in the manner previously described herein.

Most known couplings, in order to reduce the likelihood of damage to the rotor shaft, and to prevent damage to the rotor-shaft-to-motor-shaft coupling, are flexible to allow for movement. Such movement may be caused by jarring of the rotor by pieces of dross or brick present in the molten metal, or simply by forces generated by the movement of the rotor within the molten metal. Such a coupling is disclosed in pending U.S. patent application Ser. No. 08/759,780 to Cooper entitled "Molten Metal Pumping Device," the disclosure of which is incorporated herein by reference. Another flexible coupling is described in U.S. Pat. No. 5,203,681 to Cooper at column 13, 1.47-column 14, 1.16.

When a monolithic rotor is used, it is preferred that the rotor be rigidly centered in the pump casing and, hence, within the first bearing surface, such as surface 62A' shown in FIG. 3A. The preferred method for rigidly centering the rotor is by the use of a rigid motor-shaft-to-rotor-shaft coupling 600, as described in greater detail below. Maintaining the rotor centered helps to ensure a smooth operation of the pump and reduces the costs involved in replacement of damaged parts.

Figure 10:
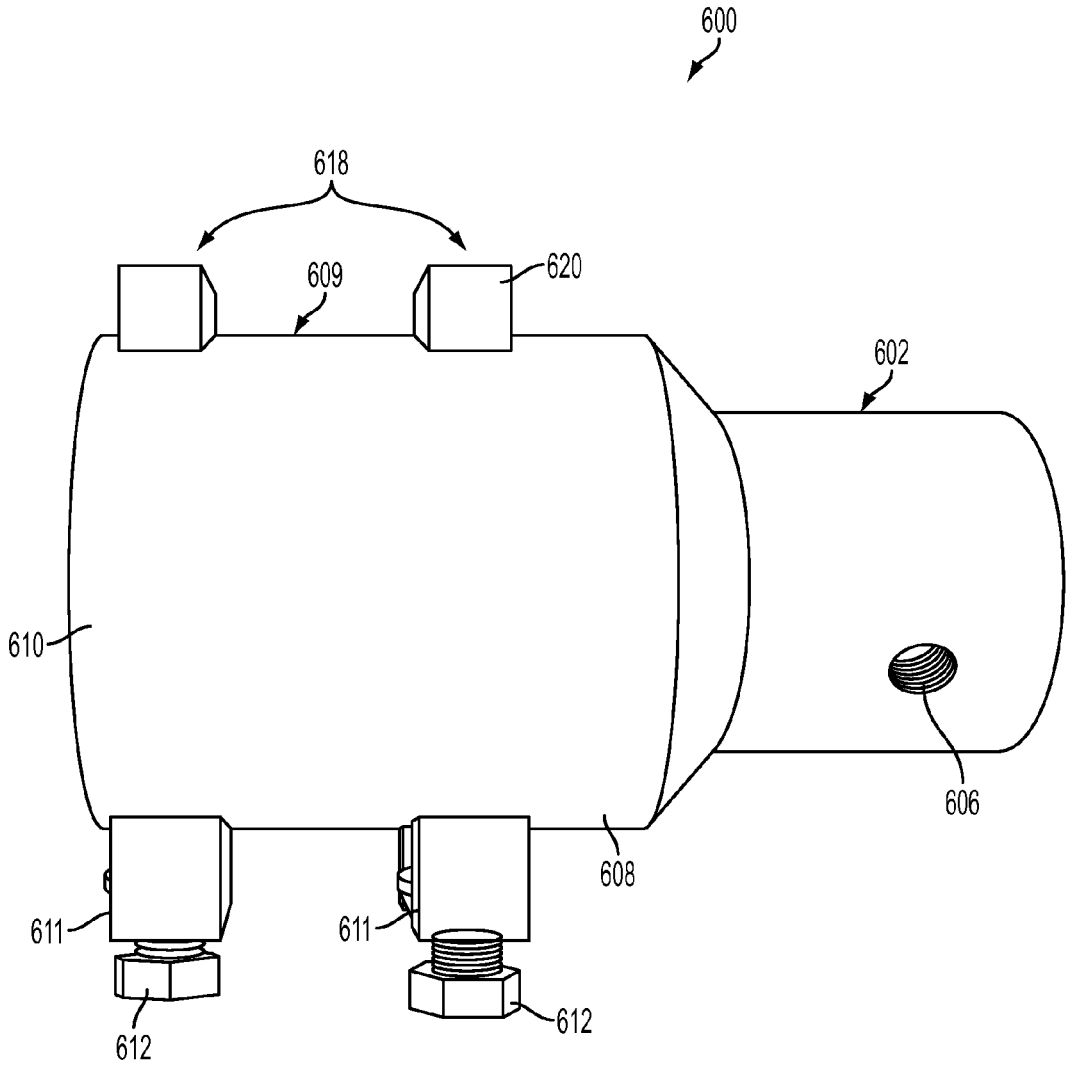
FIG. 10 is a perspective view of a rigid coupling member according to the invention.
Figure 11:
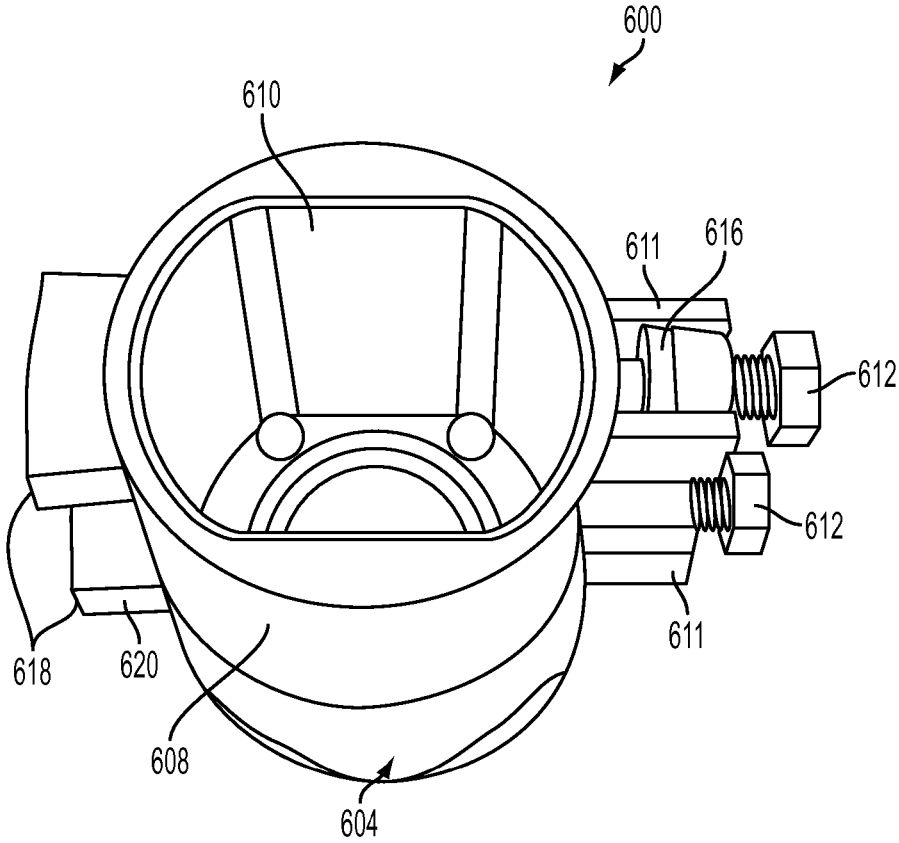
FIG. 11 is a bottom, perspective view of the coupling member shown in FIG. 10.

An embodiment of a rigid coupling according to the present invention is shown in FIGS. 10-11. Rigid coupling 600 vertically and rigidly couples a motor shaft to a rotor shaft, such as rotor shaft 38. Rigid coupling 600 is preferably a one-piece coupling incorporating two coupling members, first member 602 and second member 604. Member 602 can be any structure designed to connect to and receive suitable driving force from a motor shaft. In the preferred embodiment, coupling 602 is designed to receive a motor shaft (which is preferably cylindrical or keyed), within an opening (not shown) formed in upper surface 608. Set screws (not shown), are positioned in apertures 606, of which there are preferably three that are spaced equally about the circumference of member 602. The set screws are tightened against motor shaft 42 to help retain shaft 42 within the opening (not shown) of coupling 602.

Other rigid couplings may be used to practice the invention and include a counterbalance to keep the shaft and rotor centered during operation. For example, if rotor shaft 38 includes an internal passage for transferring gas, second coupling member 604 could be replaced by a coupling such as coupling 100 disclosed in U.S. Pat. No. 5,678,807 to Cooper entitled "Rotary Degasser," the disclosure of which is incorporated herein by reference. Further, the coupling shown in U.S. Pat. No. 6,093,000 may be used with a counterweight opposite the boss or bolt-retention device.

Second coupling member 604 is designed to rigidly retain rotor shaft 38 and includes an external surface or wall 608 and an opening 610. Member 604 preferably has an apparatus external to, and preferably attached to, external wall 608. The apparatus in the preferred embodiment is any structure or device for engaging or connecting coupling member 604 to rotor shaft 38. In the embodiment shown, one or more bosses or bolt-retention devices 611 are provided. Each of the two bolt-retention devices 611 has a bolt 612 received therein wherein each bolt 612 aligns with an aperture 614 formed in second coupling member 604. Each bolt-retention device 611 preferably includes a device, such-as a T-cap device 616, that is pushed by a bolt 612 into a pressure fit alignment with the outer surface of an end of shaft 38 in order to secure shaft 38 in second coupling member 604. The threaded end of a bolt 612 is preferably threaded into an end of T-cap 616 and as bolt 612 is tightened, the T-cap device presses against the external surface of the end of rotor shaft 38. The part of T-cap 616 that presses against shaft 38 is preferably not threaded and wide enough so that it does not penetrate shaft 38 to a great degree. If device 616 were to significantly penetrate shaft 38, shaft 38 could eventually break.

An optional counterbalance 618 is positioned generally opposite the apparatus to assist in reducing nonconcentric (e.g., wobbly) movements during rotation of the rotor shaft. The counterbalance (or counterweight) can be any structure capable of performing this function and may be attached to coupling 600 in any suitable manner. In the embodiment shown, counterbalance 618 is two weight structures 620 that are approximately aligned along a horizontal axis with each of the corresponding bolt-retention devices 611. Counterbalance 618 helps balance coupling 600. Counterbalance 618 may be any shape or size, or made of any material, but the structure and weight of any counterbalance should be sufficient to balance against the weight of the apparatus, or to otherwise assist in maintaining the concentric movement of rotor shaft 38.

Figure 18:
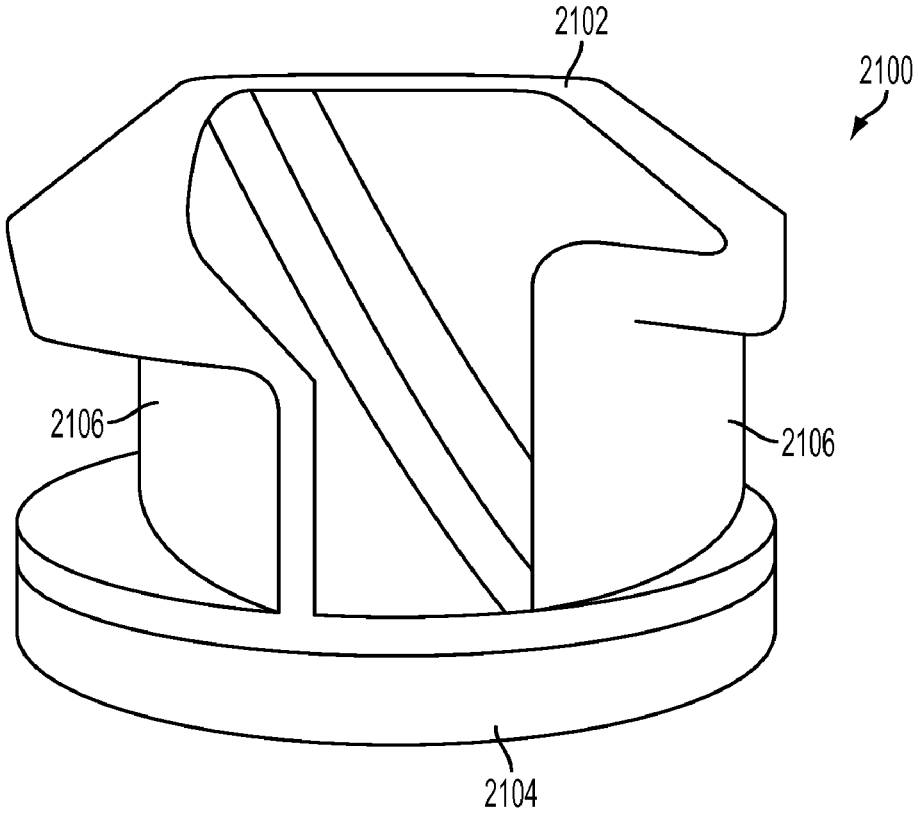
FIG. 18 is a side view of an alternate impeller that may be used in a pump according to the invention.
Figure 19:
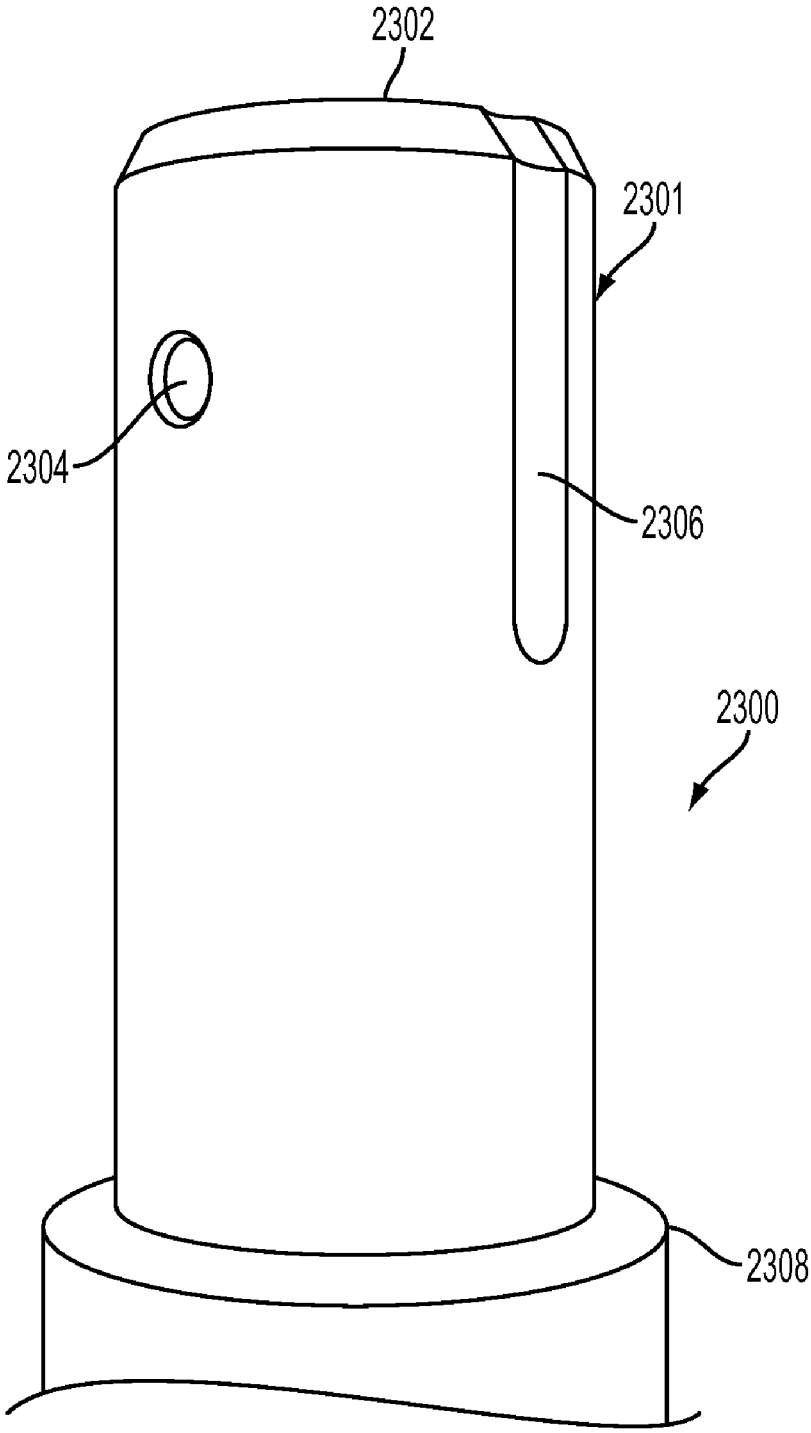
FIG. 19 is an end of an alternate rotor shaft according to the invention.

A rotor shaft 2300 is shown in FIGS. 18 and 19. Shaft 2300 may be used with impeller 2000 or 2100 or any suitable impeller for use in a molten metal pump. Shaft 2300 has a non-coated graphite component 2301, a first end 2302 and a second end 2310. End 2302 has a bolt hole 2304 and a groove 2306 formed in its outer surface. A protective coating 2308 is positioned on non-coated component 2301 and extends from end 2302 to end 2310. Second end 2310 has flat, shallow threads 2312, although second end 2310 can have any structure suitable for connecting to a rotor.

Figure 20:
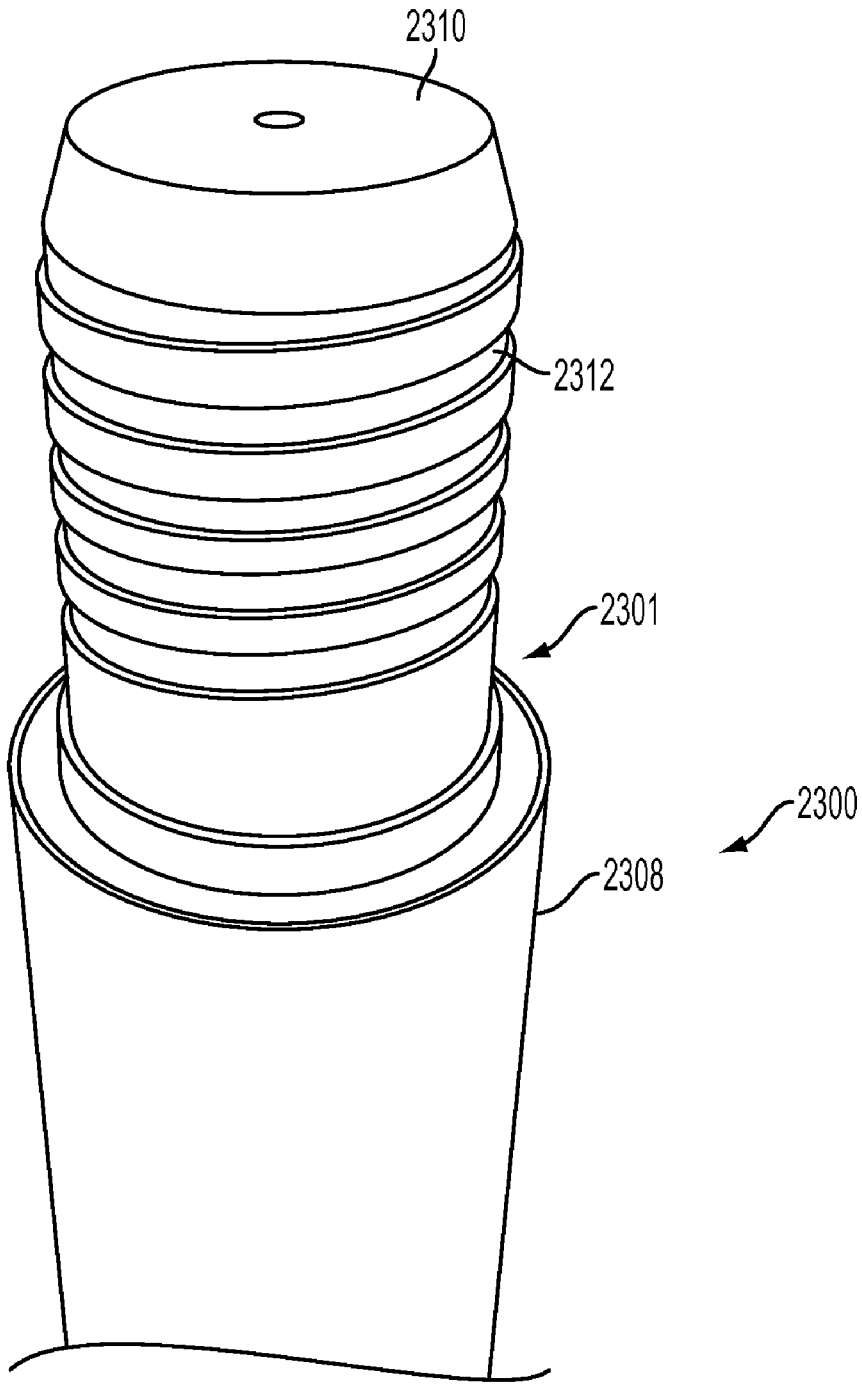
FIG. 20 is the opposite end of the rotor shaft shown in FIG. 19.
Figure 21:
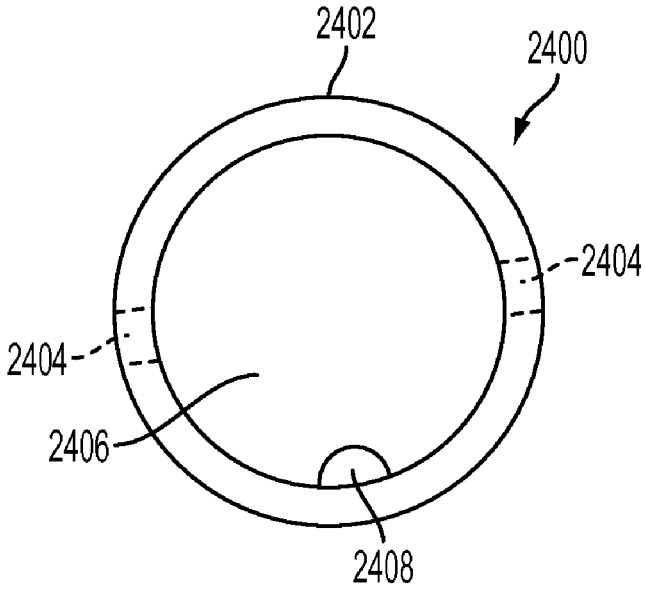
FIG. 21 is a partial cross-sectional end view of a coupling that may be used with the shaft shown in FIGS. 19-20.
Figure 22:
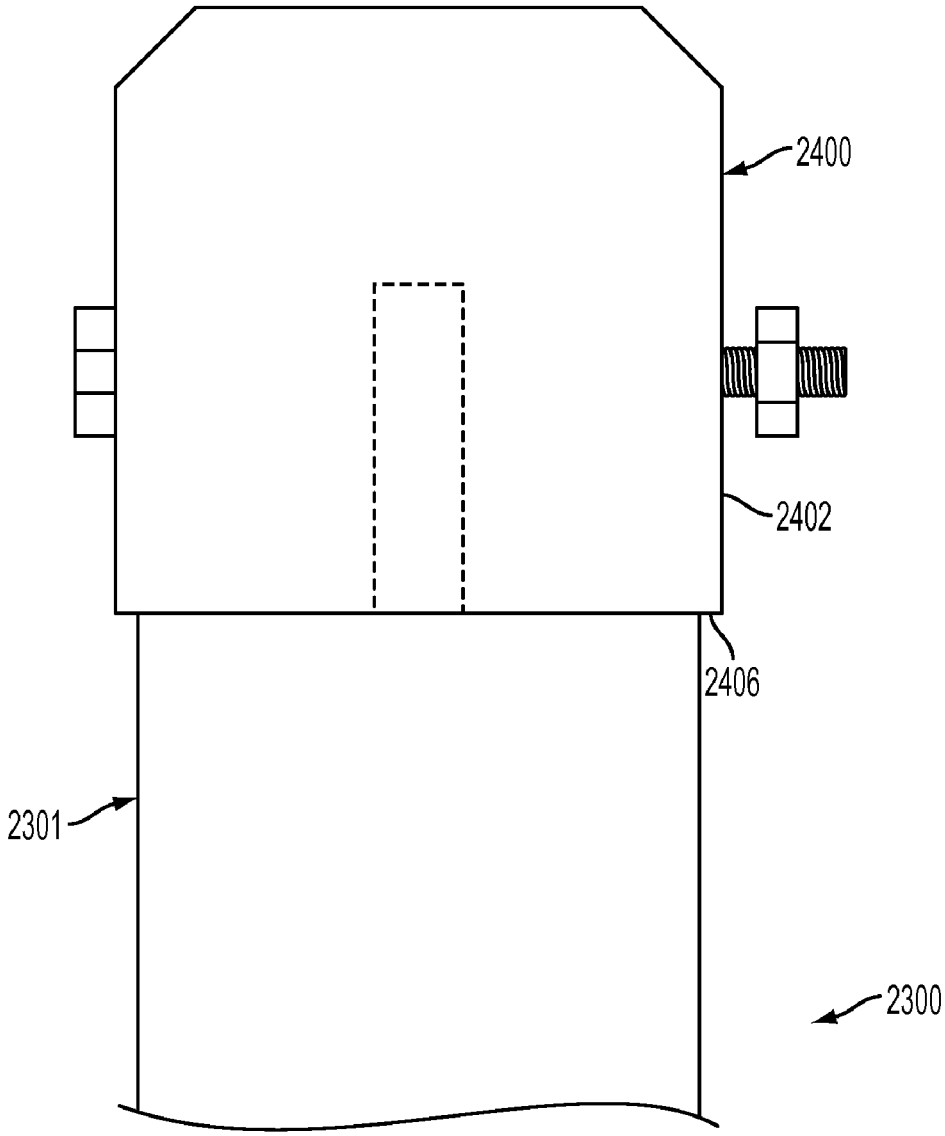
FIG. 22 is a partial side, partial cross-sectional side view of the coupling of FIG. 21 shown connected to the end of the rotor shaft shown in FIG. 18.

A coupling 2400 is shown in FIGS. 20 and 21. Coupling 2400 has a second end 2402 designed for coupling a rotor shaft having an end configured like end 2302 of shaft 2300 and further includes a first end configured to couple to the end of a motor shaft. The first end configured to couple to a motor shaft has the same structure as shown and described in one or more of the references to Cooper incorporated by reference herein, and shall not be described in detail here.

Second end 2402 of coupling 2400 has an annular outer wall 2403 and two aligned apertures 2403 formed therein. A cavity 2406 is defined by wall 2403 and a ridge 2408 is positioned on the inner surface of wall 2403. Ridge 2408 is preferably a section of steel welded to wall 2403 such that its end is substantially flush with the end of section 2402. Ridge 2408 preferably has a length no greater than, and most preferably less than, the length of groove 2306.

As best seen in FIG. 21, end 2302 is received in cavity 2406 and groove 2306 receives ridge 2408. Bolt hole 2304 aligns with apertures 2404 and a bolt 2450 is passed through apertures 2404 and through bolt hole 2304. A nut 2452 is then secured to end bolt 2450. In this manner, shaft 2300 is driven by the connection of groove 2306 and ridge 2408 and is less likely to be damaged.

Figure 6:
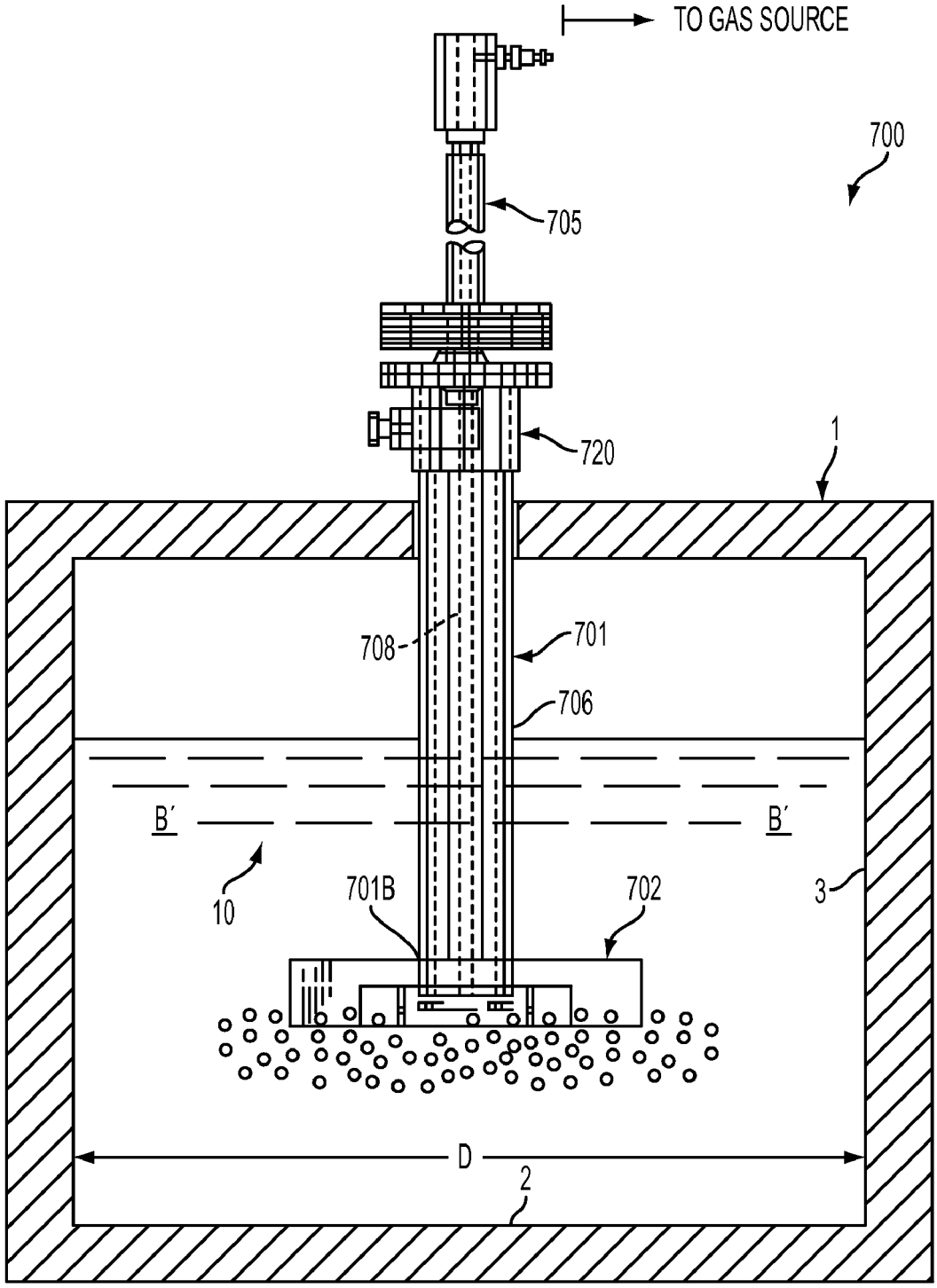
FIG. 6 shows a rotary degasser according to the invention.

FIG. 6 shows a preferred gas-release device 700 according to the invention. Device 700 is designed to operate in a molten metal bath B' contained within a vessel 1. Device 700 is preferably a rotary degasser and includes a shaft 701, an impeller 702 and a drive source (not shown). Device 700 preferably also includes a drive shaft 705 and a coupling 720. Shaft 701 and impeller 702 are preferably made of graphite impregnated with an oxidation-resistant solution.

Preferred device 700 is described in greater detail in U.S. patent application Ser. No. 09/569,461 to Cooper entitled "Molten Metal Degassing Device," the disclosure of which is incorporated herein by reference. A coupling 720 that may be used in device 700 is described in U.S. Pat. No. 5,678,807, the disclosure of which is incorporated herein by reference.

Figure 7:
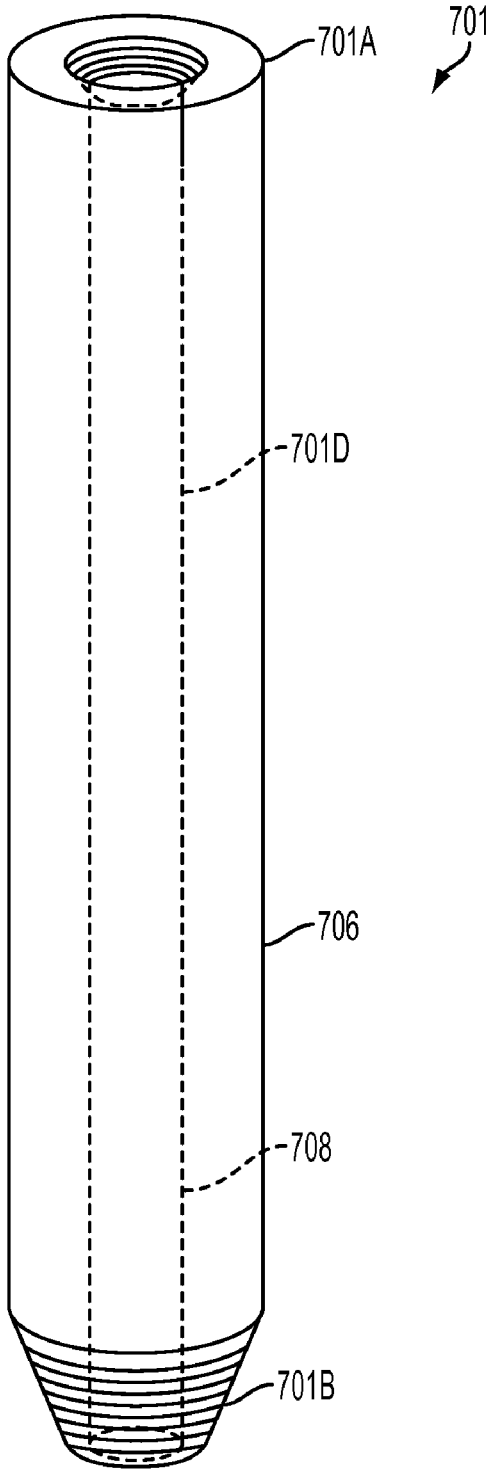
FIG. 7 is an elevational view of the shaft of the degasser of FIG. 6.

As is illustrated in FIGS. 6 and 7, shaft 701 has a first end 701A, a second end 701B, a side 706 and an inner passage 708 for transferring gas. End 701B preferably has a structure, such as the threaded end shown, for connecting to an impeller. Shaft 701 may be a unitary structure or may be a plurality of pieces connected together. The purpose of shaft 701 is to (1) connect to impeller 702 in order to rotate the impeller, and (2)

transfer gas into the molten metal bath. Any structure capable of performing these functions can be used.

Figure 8:
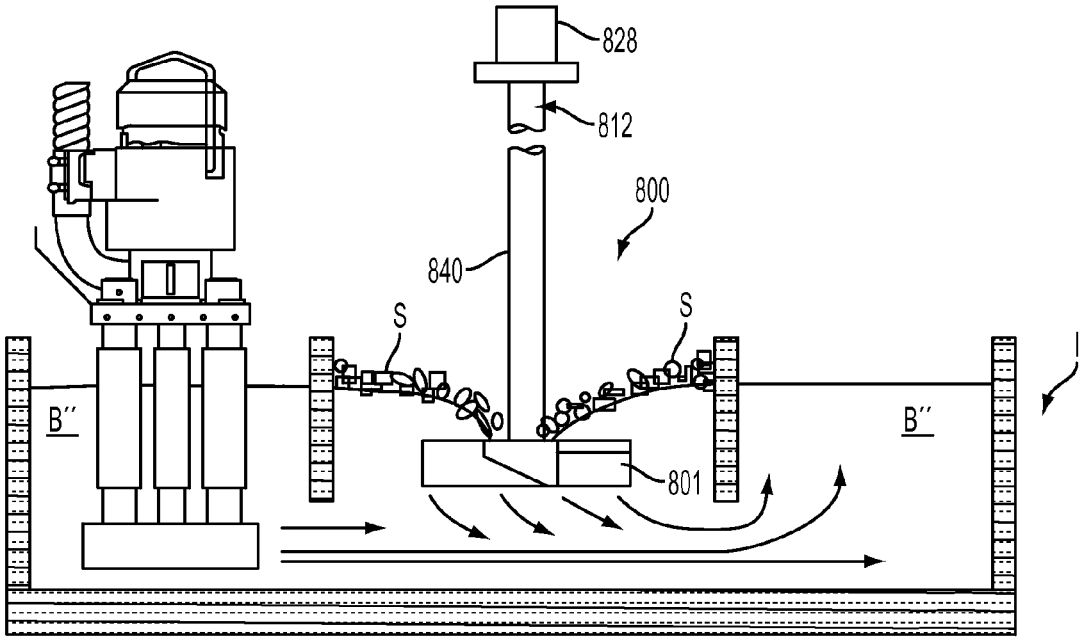
FIG. 8 shows a scrap melter according to the invention.
Figure 9:
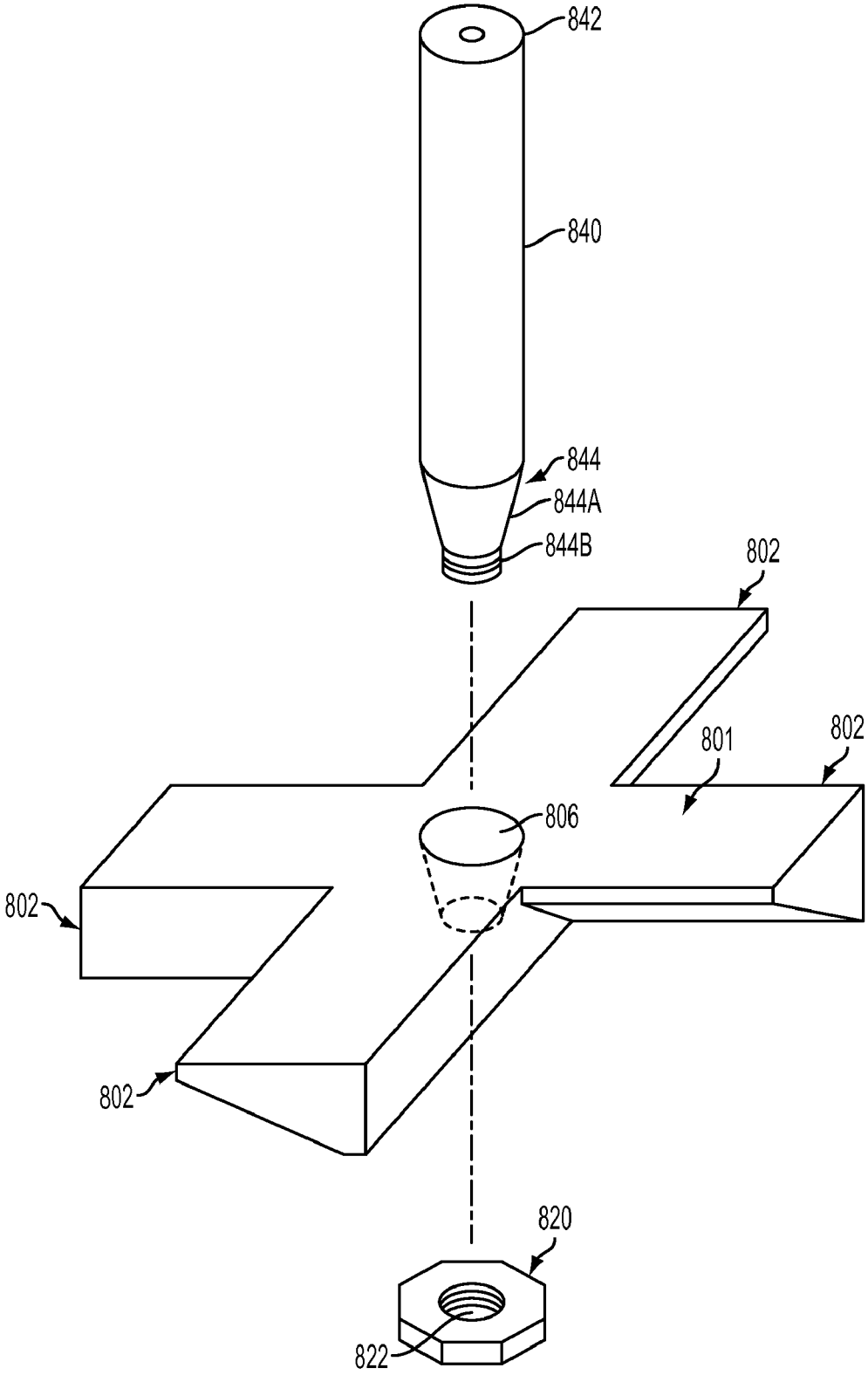
FIG. 9 is view showing the shaft and impeller of the scrap melter of FIG. 8.

FIGS. 7 and 8 show a scrap melter 800. All of the components of scrap melter 800 exposed to molten metal bath B" are preferably formed from oxidation-resistant graphite or other material suitable for use in molten metal. Preferred scrap melters that may be used to practice the invention are described in U.S. patent application Ser. No. 09/049,190 to Cooper, filed Aug. 28, 2000, U.S. Pat. No. 4,598,899 to Cooper and U.S. Pat. No. 4,930,986 to Cooper.

A drive source 828 is connected to impeller 801 by any structure suitable for transferring driving force from source 828 to impeller 801. Drive source 828 is preferably an electric, pneumatic or hydraulic motor although, as used herein, the term drive source refers to any device or devices capable of rotating impeller 801.

A drive shaft 812 is preferably comprised of a motor drive shaft (not shown) connected to an impeller drive shaft 840. The motor drive shaft has a first end and a second end, the first end being connected to motor 828 by any suitable means and which is effectively the first end of drive shaft 812 in the preferred embodiment. An impeller shaft 840 has a first end 842 (shown in FIG. 13) and a second end 844. The preferred structure for connecting the motor drive shaft to impeller drive shaft 840 is a coupling (not shown). The coupling preferably has a first coupling member and a second coupling member. The first end 842 of impeller shaft 840 is connected to the second end of the motor shaft, preferably by the coupling, wherein the first end 842 of impeller shaft 840 is connected to the second coupling member and the second end of the motor drive shaft is connected to the first coupling member. The motor drive shaft drives the coupling, which, in turn, drives impeller drive shaft 840. Preferably, the coupling and first end 842 of the impeller shaft 840 are connected without the use of connecting threads.

Figure 13:
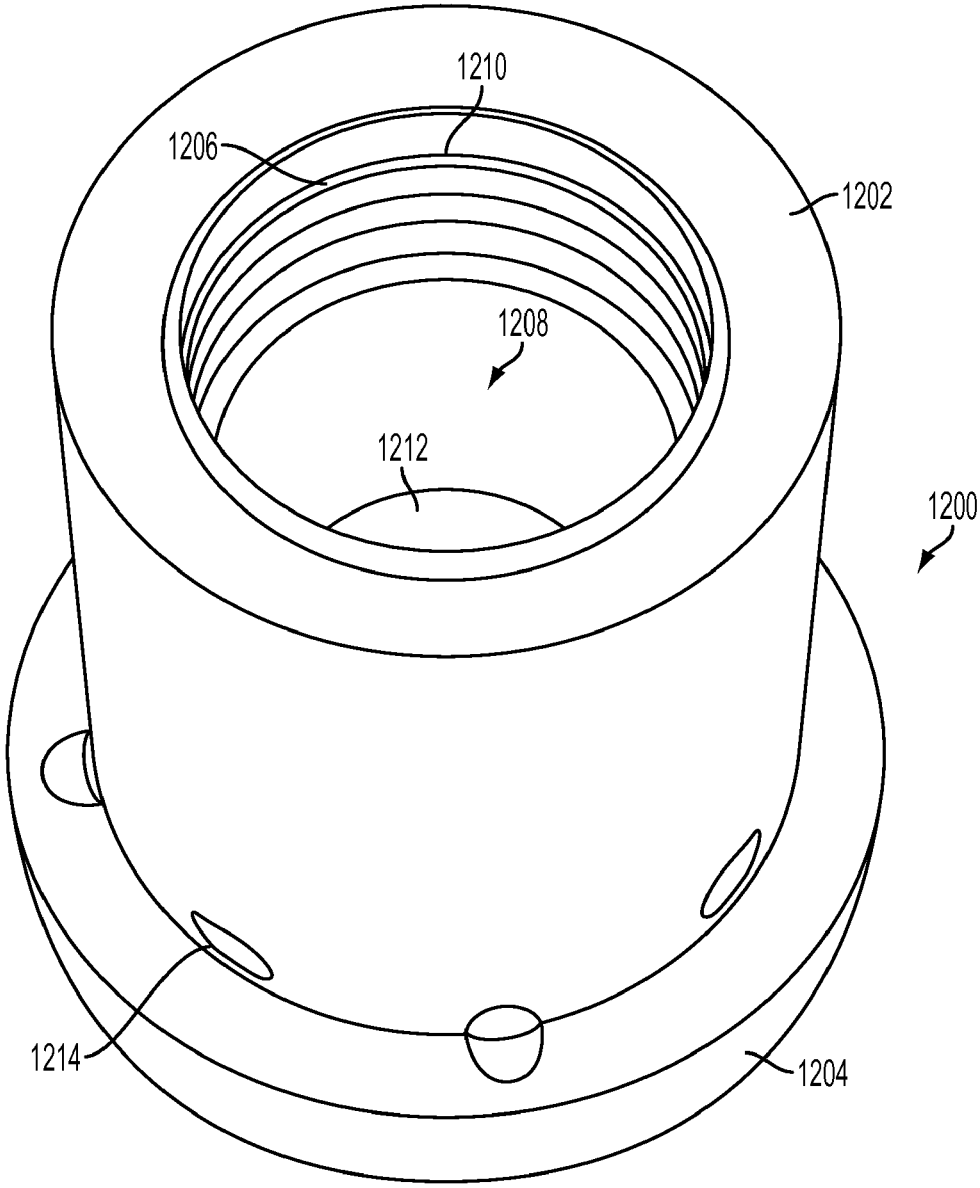
FIG. 13 is a bottom perspective view of the second coupling member of FIG. 12.

Impeller 801 is an open impeller. The term "open" used in this context refers to an impeller that allows dross and scrap to pass through it, as opposed to impellers such as the one shown in U.S. Pat. No. 4,930,986, which does not allow for the passage of much dross and scrap, because the particle size is often too great to pass through the impeller. Preferred impeller 801 is best seen in FIG. 13. Impeller 801 provides a greater surface area to move molten metal than conventional impellers, although any impeller suitable for use in a scrap melter may be used. Impeller 801 may, for example, have a perforate structure (such as a bird-cage impeller, the structure of which is known to those skilled in the art) or partially perforate structure, and be formed of any material suitable for use in a molten metal environment. Impeller 801 is preferably imperforate, has two or more blades, is attached to and driven by shaft 812 (by being attached to shaft 840 in the preferred embodiment), and is preferably positioned centrally about the axis of shaft 840.

Figure 12:
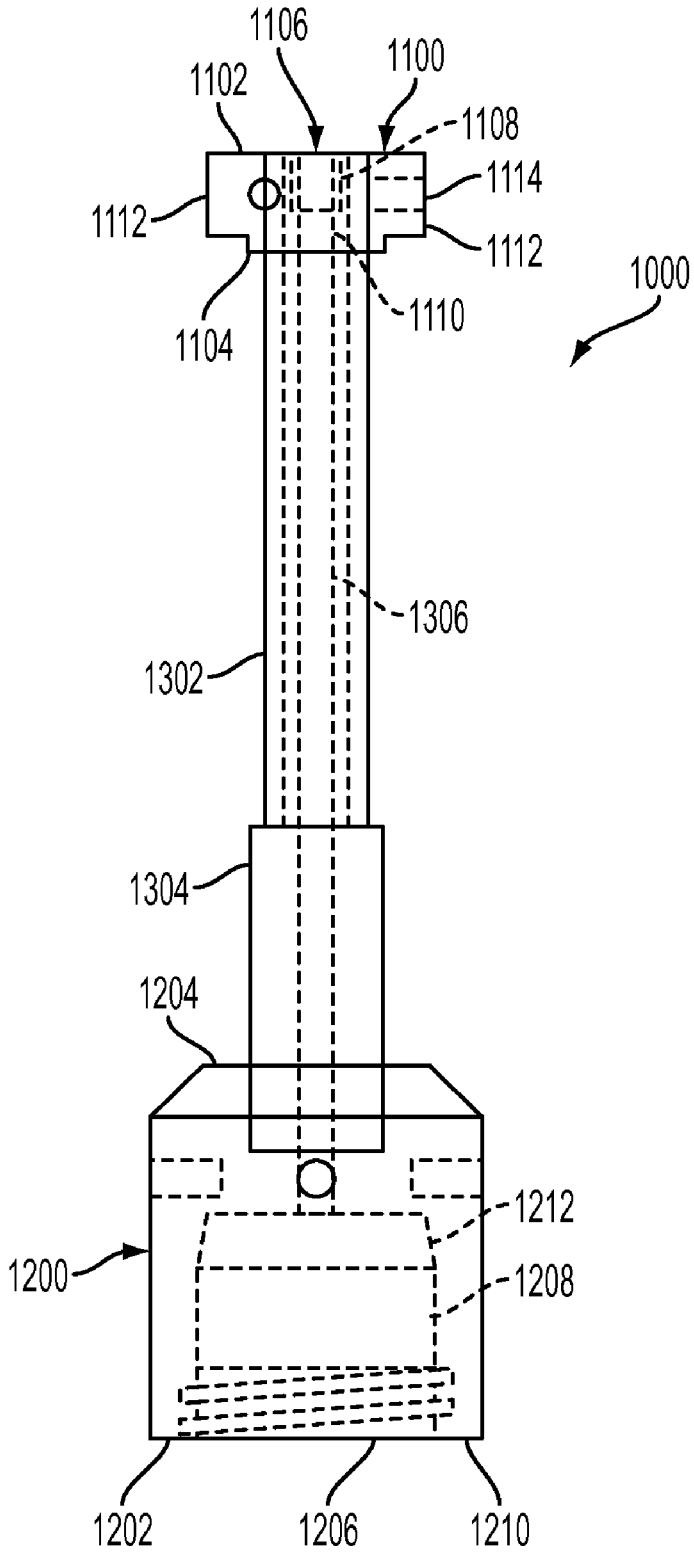
FIG. 12 is a side view of a preferred coupling for transferring gas between two shafts, the coupling including a first coupling member and a second coupling member.
Figure 14:
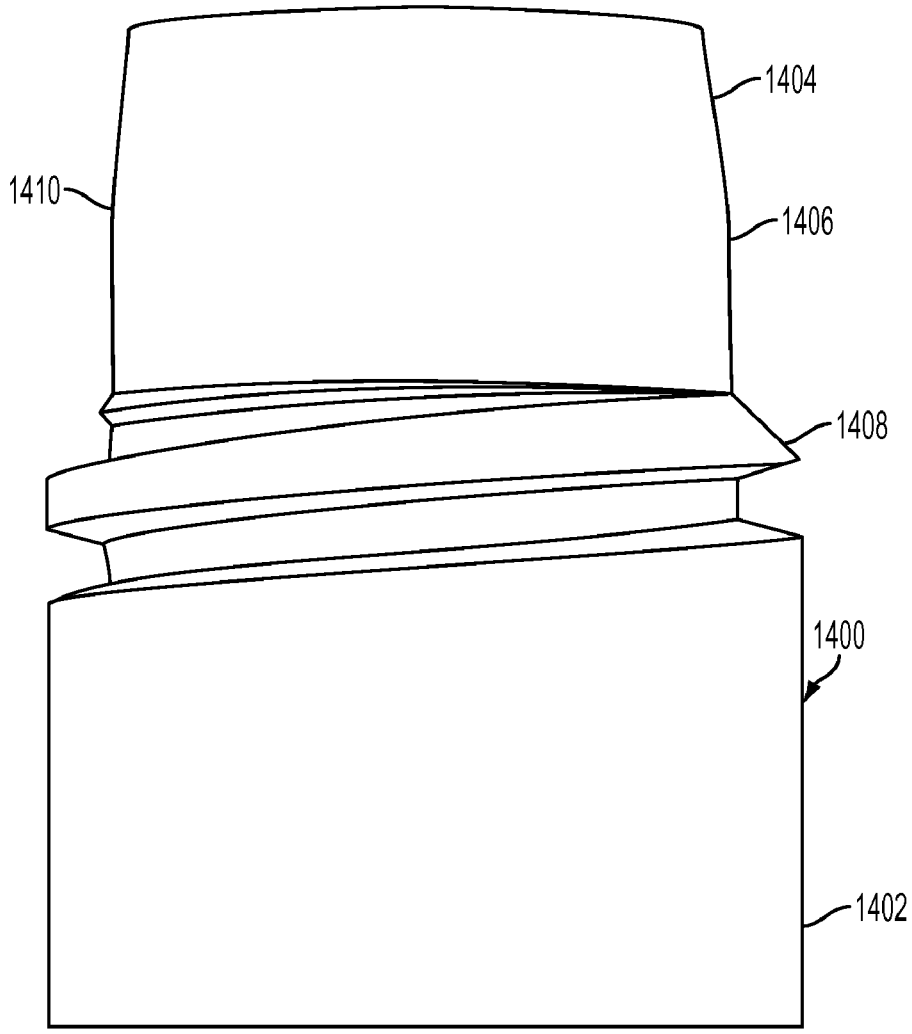
FIG. 14 is a side view of a shaft with an end configured to be received in the second coupling member of FIG. 13.

FIG. 12 shows a coupling 1000 for connecting to a shaft and transferring gas to the shaft. A preferred shaft to which gas is transferred is shown in FIG. 14. Coupling 1000 is preferably made of stainless steel and preferably includes a first coupling member 1100, a second coupling member 1200, a shaft 1300, and a passage 1110. Member 1100 is a generally known structure for gas transfer and includes a leading surface 1102 and a trailing surface 1104. An opening 1106 leads to a tapered bore 1108 formed in member 1100 between leading surface 1102 and passage 1110. Flanges 1112 include apertures 1114 for receiving bolts (not shown) or set screws (not shown). Coupling member 1100 connects to the motor drive shaft of a rotary degasser or any other device, such as a molten metal pump, wherein gas is transferred from the motor device shaft into another shaft. Any structure capable of connecting coupling 1000 to the motor drive shaft may be used.

Shaft 1300 has parts 1302 and 1304, although any shaft may be used or there may be no shaft between coupling members 1100 and 1200. A passage 1306 is formed in shaft 1300 in order to transfer gas from coupling member 1100 to coupling member 1200.

Coupling member 1200, shown in FIGS. 12 and 13, has a proximal end 1202 and a distal end 1204. An opening 1206 leads to a bore 1208. Bore 1208 contains threads 1210 juxtaposed the proximal end. Threads 1210 are preferably coarse ACME threads (most preferably ⅜" ACME thread) to allow for easy installation and removal of the rotor shaft. End 1212 of bore 1208 near the distal end 1204 is tapered, contains no threads and is preferably smooth. Apertures 1214 are designed to receive a tool (not shown) for disconnecting the shaft from the coupling.

Rotor shaft 1400, shown in FIG. 14, is preferably comprised of oxidation-resistant graphite, although any material (s) suitable for use in a molten metal bath may be used, and has an outermost perimeter 1402. An end 1404 is structured to be received into bore 1208 of second coupling member 1200 so that gas may be transferred from passage 1306 into passage 1410. End 1404 includes a generally smooth, tapered portion 1406 and a threaded portion 1408 between tapered portion 1406 and outermost perimeter 1402. The opposite end (not shown) of shaft 1400 can be of any configuration, including a configuration for connecting to an impeller or other structure.

When end 1404 is received in bore 1208, tapered portion 1406 is received into the tapered portion 1212 of bore 1208. When these tapered, generally smooth surfaces align, the close fit helps to prevent gas leakage (gas leakage could occur if this upper portion 1406 of the bore were threaded, because the threads do not mate perfectly and gas seeps between them) and helps to center the shaft and reduce shaft vibration. When gas leakage is reduced, less gas contacts the graphite threads in threaded portion 1408 of shaft 1400. The threads thus remain stable longer (because certain gases, such as chlorine gas, degrade the threads) and shaft 1400 lasts longer.

Turning now to FIG. 15, a magnetic coupling 2000 that can be used with either a pump or a scrap melter is shown. The coupling is preferably manufactured by MagnaDrive Corporation, 1177 Fairview Avenue North, Seattle, Wash. 98109, and is a MagnaGuard MGTL coupling. This coupling includes the following features: (1) torque is transferred from a conductor (motor) to permanent magnets (load); there is an air gap separating the motor from the load, and (2) varying the air gap alters the torque and speed of the driven shaft. These features assist in eliminating vibration transfer. Moreover, because there is a complete dislocation of the motor shaft (and motor) from the rotor shaft, in case of overload (which can occur if there is a jam), the torque of the driving (motor) shaft is disconnected from the driven (rotor) shaft thus helping to prevent component damage. When the jam is cleared, the coupling automatically resets itself to resume operation. A further benefit of this coupling is that it can eliminate the need and expense of variable speed motors, and could possibly eliminate the need for a gear box. Moreover, the rotor shaft need not be perfectly aligned with the motor shaft.

Coupling 2000 has a first coupling member 2002 and a second coupling member 2004. Coupling member 2002 connects to an end of motor shaft (not shown) and coupling member 2004 connects to an end of rotor shaft (not shown). Instead of coupling members 2002 and 2004 being physically connected, coupling member 2002 and coupling member 2004 are received into housing 2006 of coupling 2000, and there is a gap between members 2002 and 2004. Disk 2008 of member 2002 and 2010 of member 2004 face each other and the magnetic force of disk 2008 drives disk 2010, member 2002 and the rotor shaft. By varying the gap between members 2002 and 2004, the torque transmitted from member 2002 to member 2004 may be varied, i.e., the greater the gap, the lower the torque transmission.

Having thus described different embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A rotary degasser including:

(a) a motor;

(b) a motor shaft having a first end and a second end, the first end connected to the motor;

(c) a coupling having a first coupling member and a second coupling member, the first coupling member connected to the second end of the motor shaft, the second coupling member comprising a bore having an opening, the bore for receiving an end of a rotor shaft through the opening, the bore having an end distal the opening and an end proximal the opening, the distal end being tapered and not threaded, the proximal end being threaded, the distal end comprising a passage for transferring gas, the first coupling member in communication with the passage;

(d) a rotor shaft having:

(i) a first end and a second end, the first end being received in and connected to the second coupling member; and (ii) a passage through the rotor shaft, the passage including an opening in the first end of the rotor shaft and an opening in the second end of the rotor shaft; and (e) a rotor connected to the second end of the rotor shaft.

2. The rotary degasser of claim 1 wherein the proximal end of the second coupling member is threaded.

3. The rotary degasser of claim 2 wherein the threads are coarse threads.

4. The rotary degasser of claim 1 wherein the coupling is comprised of stainless steel.

5. The rotary degasser of claim 1 wherein the distal end of the bore has a smooth surface.

6. The rotary degasser of claim 1 wherein the coupling further comprises one or more apertures configured to receive a tool for disconnecting the shaft from the coupling.

7. The rotary degasser of claim 6 wherein each of the one or more apertures is configured to receive a bolt to connect the shaft and the coupling.

8. The rotary degasser of claim 3 wherein the threads are coarse ACME threads.

9. The rotary degasser of claim 8 wherein the threads are coarse ⅜" ACME threads.

10. The rotary degasser of claim 1 wherein the coupling further includes a counterweight.

11. The rotary degasser of claim 10 wherein the counterweight is on an exterior surface of the second coupling member.

12. The rotary degasser of claim 1 wherein the first coupling member has a cylindrical opening that receives the second end of the motor shaft.

* * * * *